US008142011B2

(12) United States Patent
Kobayashi

(10) Patent No.: US 8,142,011 B2
(45) Date of Patent: Mar. 27, 2012

(54) IMAGE RECORDING DEVICE AND IMAGE RECORDING METHOD

(75) Inventor: Isao Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1025 days.

(21) Appl. No.: 12/058,285

(22) Filed: Mar. 28, 2008

(65) Prior Publication Data

US 2008/0240753 A1 Oct. 2, 2008

(30) Foreign Application Priority Data

Mar. 30, 2007 (JP) ..... 2007-095697

(51) Int. Cl.
*B41J 29/38* (2006.01)
*G03G 15/00* (2006.01)

(52) U.S. Cl. ..... 347/104; 347/16; 347/101; 399/45

(58) Field of Classification Search ..... 347/5, 16, 347/101, 102, 104; 399/45
See application file for complete search history.

(56) References Cited

U.S. PATENT DOCUMENTS

| | | | | |
|---|---|---|---|---|
| 5,238,269 | A * | 8/1993 | Levine | 281/2 |
| 5,850,478 | A | 12/1998 | Suzuki et al. | |
| 6,117,061 | A * | 9/2000 | Popat et al. | 493/325 |
| 6,753,975 | B1 | 6/2004 | Hanson | |
| 6,945,645 | B2 * | 9/2005 | Baron | 347/104 |
| 7,963,201 | B2 * | 6/2011 | Willoughby et al. | 83/210 |
| 2005/0200680 | A1 | 9/2005 | Uchida | |
| 2005/0225626 | A1 | 10/2005 | Igarashi et al. | |
| 2008/0143807 | A1 * | 6/2008 | Bartley et al. | 347/104 |
| 2009/0184992 | A1 | 7/2009 | Igarashi et al. | |

FOREIGN PATENT DOCUMENTS

| | | | |
|---|---|---|---|
| JP | H03-086576 | A | 4/1991 |
| JP | 05124183 | A * | 5/1993 |
| JP | H07-221969 | A | 8/1995 |
| JP | H11-091191 | A | 4/1999 |
| JP | 2001-138597 | A | 5/2001 |
| JP | 2002292949 | A | 10/2002 |
| JP | 2005-289049 | A | 10/2005 |
| JP | 2005-313603 | A | 11/2005 |

OTHER PUBLICATIONS

Japan Patent Office, Office Action for Japanese Patent Application No. 2008-085707 (counterpart to above-captioned patent application), mailed Oct. 25, 2011.

* cited by examiner

*Primary Examiner* — Daniel Petkovsek
(74) *Attorney, Agent, or Firm* — Baker Botts L.L.P.

(57) ABSTRACT

An image recording device includes a first detecting unit, a recording unit, and a control unit. The first detecting unit detects a position of a perforation pre-formed in a recording sheet. The recording unit records an image on the recording sheet based on printing data. The control unit is configured to imaginarily divide the recording sheet into a first region including a portion where the perforation is pre-formed, and a second region excluding the first region based on the position of the perforation detected by the first detecting unit. The control unit prohibits the recording unit from recording the image on the first region and controls the recording unit to record the image at least partially on the second region.

23 Claims, 11 Drawing Sheets

PATTERN IMAGE DATA A

PATTERN IMAGE DATA B

PATTERN IMAGE DATA C

PATTERN IMAGE DATA D
35
50
15
53
65
68

FIG.9

36

| RECORDING SHEET SIZE | POSITION | SHAPE | SIZE | NUMBER OF PERFORATIONS | PATTERN |
|---|---|---|---|---|---|
| A4 | (X1, Y1) | ROUND | LARGE | 2 | A |
| B5 | (X2, Y2) | ROUND | LARGE | 26 | A |
| | (X3, Y3) | TETRAGONAL | LARGE | 26 | C |
| A5 | (X4, Y4) | ROUND | LARGE | 6 | A |
| BIBLE | (X5, Y5) | ROUND | SMALL | 6 | B |
| 6 | (X6, Y6) | ROUND | SMALL | 6 | B |
| 5 | (X7, Y7) | ROUND | SMALL | 5 | B |

IMAGE RECORDING DEVICE AND IMAGE RECORDING METHOD

CROSS REFERENCE TO RELATED APPLICATION

This application claims priority from Japanese Patent Application No. 2007-095697 filed Mar. 30, 2007. The entire content of this priority application is incorporated herein by reference.

TECHNICAL FIELD

This invention relates to an image recording device and an image recording method for recording an image by ejecting ink onto a recording medium that is conveyed along a predetermined conveyance path.

BACKGROUND

A recording sheet having perforations may be used in an image recording device such as an ink-jet printer. The perforated sheets may be bound into a loose leaf notebook or a system notebook after printing. Japanese Patent Application Publication No. 11-91191 (hereinafter, referred as Patent Document 1) discloses printer that detects the perforations of a recording sheet. Japanese Patent Application Publication No. 2002-292949 (referred as Patent Document 2) discloses that executes a printing process based on information about perforations.

A printer device described in Patent Document 1 includes a photo coupler. The photo coupler includes a light emitting unit for irradiating light and a detection unit for detecting light. The light emitting unit opposes the detecting unit across the conveyance path. The signal intensity of the detection signal output from the photo coupler changes when the recording sheet that is conveyed along the conveyance path cuts in the light path from the light emitting unit to the detection unit and when the recording sheet gets away from the light path from the light emitting unit to the detection. Thus, perforations cut through the recording sheet can be detected according to a change in the detection signal output from the photo coupler. In the printer device, the image to be recorded on a recording sheet is turned upside down depending on whether or not perforations are detected. In other words, by detecting perforations at prescribed positions of the recording sheet, the printing device can detect a direction of the recording sheet with respect to the conveyance path.

A printing system described in Patent Document 2 includes a printer device and a personal computer (PC) that is connected to the printer device so that the printer and the PC are capable of communicating with each other. On the setting screen, the user of the PC can specify the positions and the size of the perforations. Then, based on the information that the user sets, the PC generates printing data that do not record any image in a region having a predetermined width from the edge along which perforations are cut. Subsequently, the PC sends the printing data to the printer. The platen of the printer is not smeared when a printing process is executed by the printer based on the printing data.

SUMMARY

In the printer devices disclosed in Patent Document 2, to print various types of recording sheet, the user is required to set various cumbersome definitions for the positions and the type of perforations before the actual printing process. This operation of setting various cumbersome definitions is a load on the part of the user. When the positions and the type of the perforations defined by the user do not agree with those of the perforations that are actually cut through the recording sheet, an image can be printed at some of the perforations to smear and waste the recording sheet. Such a problem can arise not only in ink-jet recording device but also in recording device of other types such as an electro-photographic type recording device.

While the printer device described in Patent Document 1 can detect perforations, the printer device described in Patent Document 1 lacks flexibility for detecting perforations. When the recording sheet is placed out of alignment for some reason or another, the printer device can no longer detect perforations.

In order to attain the above and other objects, the invention provides an image recording device. The image recording device includes a first detecting unit, a recording unit, and a control unit. The first detecting unit detects a position of a perforation pre-formed in a recording sheet. The recording unit records an image on the recording sheet based on printing data. The control unit is configured to imaginarily divide the recording sheet into a first region including a portion where the perforation is pre-formed, and a second region excluding the first region based on the position of the perforation detected by the first detecting unit. The control unit prohibits the recording unit from recording the image on the first region and controls the recording unit to record the image at least partially on the second region.

According to another aspects, the invention provides an image recording device. The image recording device includes a conveying unit, a detecting sensor, a driving mechanism, a recording unit, and a control unit. The conveying unit conveys a recording sheet along a sheet conveyance path in a first direction. The detecting sensor detects a position of a perforation pre-formed in the recording sheet. The driving mechanism moves the detecting sensor in a second direction orthogonal to the first direction. The recording unit records an image on the recording sheet. The control unit controls the conveying unit to convey the recording sheet in the first direction and controls the driving mechanism to move the detecting sensor in the second direction. The control unit controls the detecting sensor to scan the recording sheet by controlling the conveying unit and the driving mechanism and to output a signal. The control unit detects the perforation based on the signal output from the detecting sensor.

According to another aspects, the invention provides an image recording method. The image recording method includes (a) detecting a position of a perforation pre-formed in a recording sheet, (b) dividing the recording sheet into a first region including a portion where the perforation is pre-formed, and a second region excluding the first region based on the position of the perforation detected in the detecting step (a), (c) prohibiting recording the image on the first region, and (d) recording the image at least partially on the second region.

BRIEF DESCRIPTION OF THE DRAWINGS

Embodiments in accordance with the invention will be described in detail with reference to the following figures wherein:

FIG. 9 is a schematic view of a pattern table;

DETAILED DESCRIPTION

An embodiment of the invention will be described while referring to the accompanying drawings.

Figure 1:
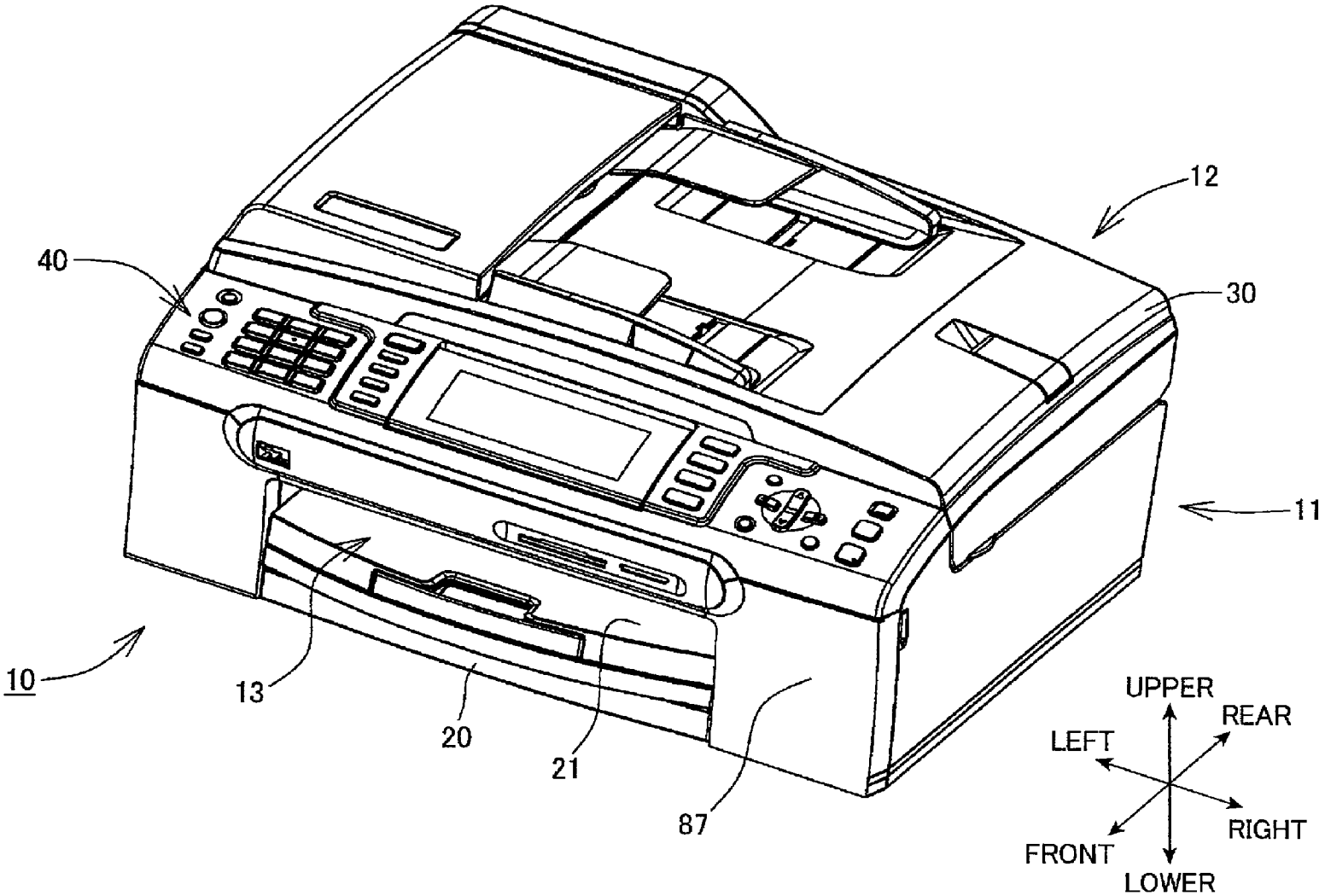
FIG. 1 is a perspective view showing an external configuration of a multifunction device according to an embodiment.

An image recording device according to an embodiment of the invention will be described while referring to FIGS. 1 through 11. The image recording device of the embodiment is applied to a multifunction device. FIG. 1 is a perspective view of a multifunction device (MFD) 10, showing the external configuration thereof.

In the following description, the expressions "front", "rear", "upper", "lower", "right", and "left" are used to define the various parts when the multifunction device 10 is disposed in an orientation in which it is intended to be used.

As shown in FIG. 1, the multifunction device 10 has a scanner section 12 and a printer section 11 respectively in an upper part and in a lower part thereof. The multifunction device 10 has a substantially rectangular parallelepiped shape having a width (i.e., length with respect to a left-to-right direction), a depth (i.e., length with respect to a front-to-rear direction), and a height (i.e., length between an upper end and a lower end). Each of the width and the depth may be greater than the height.

The multifunction device 10 has functions of a printer, a scanner, a copier, and a facsimile machine. The printer section 11 serves as an image recording device. In other words, the functions other than a printer function are optional functions. Thus, the invention is applicable to a single function printer that does not have a scanner section and accordingly does not have a scanner or copier function.

The multifunction device 10 is connected to a terminal device 70 (see FIG. 4) by way of a LAN (local area network) 44 (see FIG. 4) so that the multifunction device 10 and the terminal device 70 can communicate with each other. The multifunction device 10 prints an image on a recording sheet 50 (see FIG. 2.) based on printing data transferred (transmitted) from the terminal device 70. The multifunction device 10 has a function of ejecting ink onto edges 53 (see FIG. 8) of the recording sheet 50 and recording an image without margins (no-margin recording, or borderless printing) based on printing data. An external device, e.g. a digital camera, can be connected to the multifunction device 10 to record an image of image data output from the digital camera on a recording sheet 50. The multifunction device 10 is capable of mounting any of various recording media such as a memory card to record an image of image data stored in the recording medium. That is, printing data of the invention is not limited to those acquired from the terminal device 70.

The scanner section 12 includes a flatbed scanner (FBS) and an automatic document feeder (ADF). As shown in FIG. 1, the multifunction device 10 is provided with a document cover 30 that operates as a top plate of the multifunction device 10. The document cover 30 can be freely opened and closed. The ADF is disposed on the document cover 30. Although not shown in the drawing, a platen glass and an image sensor are arranged under the document cover 30. An image of a document placed on the platen glass or an image of a document being conveyed by the ADF is read by the image sensor at the scanner section 12.

Printing data may be generated based on the image data of the document obtained by a document reading operation. Since the scanner section 12 is an optional structure in this embodiment, a detailed description thereof will be omitted here.

An operation panel 40 is arranged at an upper front position on the top of the multifunction device 10. The operation panel 40 is a device for operating the printer section 11 and the scanner section 12. The operation panel 40 includes a liquid crystal display for displaying various information and input keys by which a user inputs various information. The multifunction device 10 operates according to the input operation from the operation panel 40. The multifunction device 10 also operates according to the information transmitted from the terminal device 70.

The internal configuration of the multifunction device 10, especially the configuration of the printer section 11, will be described below.

As shown in FIG. 1, the printer section 11 has an opening 13 at the front side. A sheet feeding tray 20 and a sheet discharging tray 21 are arranged in the opening 13. The sheet feeding tray 20 and the sheet discharging tray 21 are arranged vertically one on the other. That is, the sheet discharging tray 21 is located above the sheet feeding tray 20.

Figure 2:
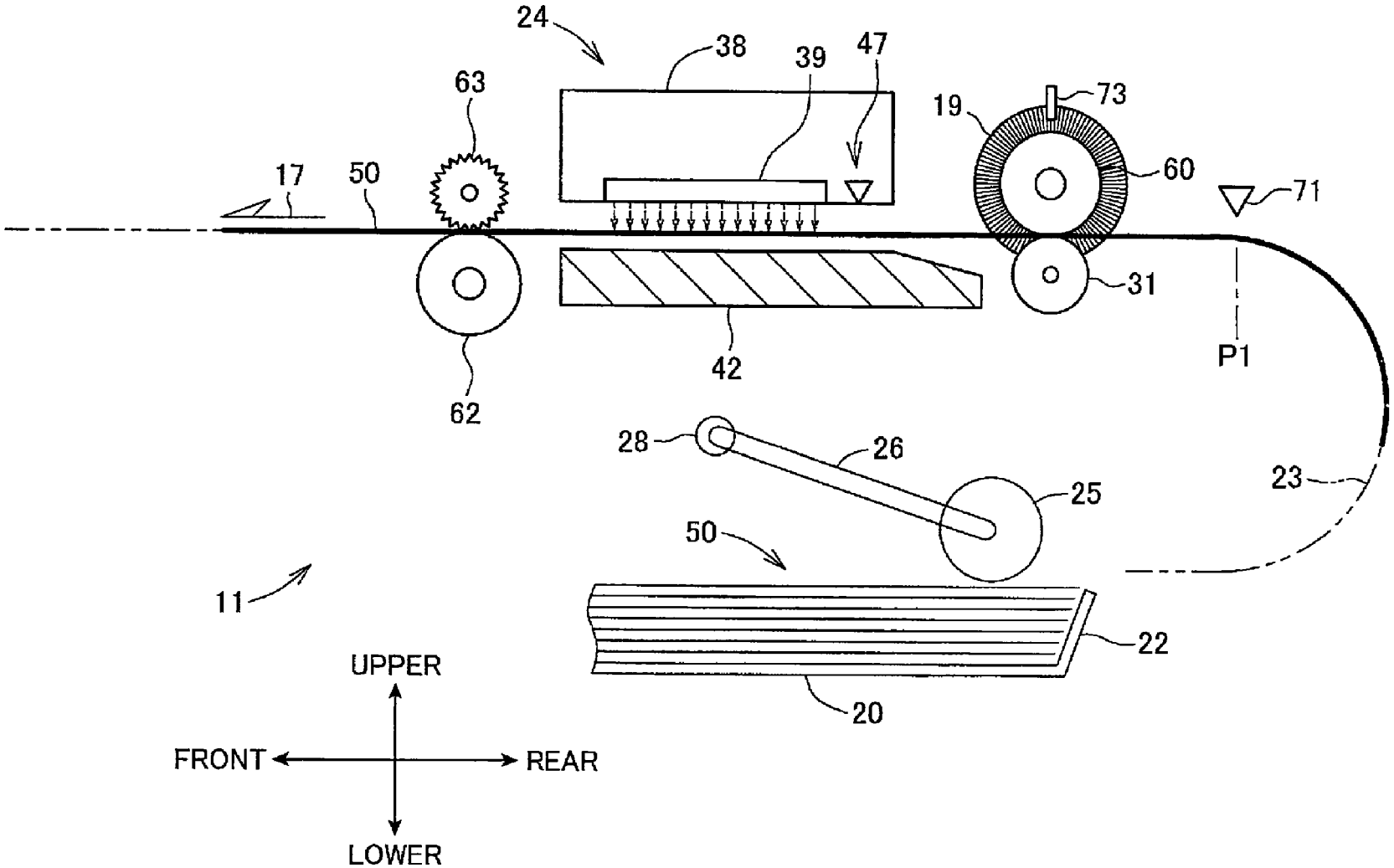
FIG. 2 is a schematic view showing an internal configuration of a printer section.

FIG. 2 is a schematic view of the printer section 11, showing the internal configuration thereof. Parts of the sheet feeding tray 20 and the sheet discharging tray 21 are omitted from FIG. 2.

The sheet feeding tray 20 accommodates one or a plurality of recording sheets 50. The sheet feeding tray 20 is capable of accommodating various sizes of recording sheets 50 standardized by the Japanese Industrial Standards (JIS). For example, the sizes defined by JIS include the A4 size, the B5 size, the A5 size, the postcard size and the photograph L size. The sheet feeding tray 20 can also accommodate recording sheets 50 provided with perforations 15 so as to be bound to a loose-leaf notebook or a day planner. In the multifunction device 10 of the embodiment, when a recording sheet 50 provided with the perforations 15 (see FIGS. 6 and 7) is used for printing, ink is ejected onto the recording sheet 50 from a recording head 39 so as to avoid the perforations 15 (see FIG. 8). The recording process of the multifunction device 10 will be described in detail later.

The sheet feeding tray 20 is located at the bottom side of the printer section 11 (see FIGS. 1 and 2). The recording sheets 50 in the sheet feeding tray 20 are supplied to the inside of the printer section 11. As shown in FIG. 2, a slope plate 22 is located at the rear side of the sheet feeding tray 20 (at the right hand side in FIG. 2). The slope plate 22 is inclined toward the rear side (toward the right side in FIG. 2) of the multifunction device 10. The slope plate 22 is provided for separating one recording sheet 50 from the remaining recording sheets 50 in the sheet feeding tray 20 and guiding the one recording sheet 50 upward. A conveyance path 23 is located above the slope plate 22. The conveyance path 23 is a path along which the recording sheet 50 is conveyed. The conveyance path 23 is partly curved.

More specifically, the conveyance path 23 extends upward and rearward side from the slope plate 22 and then is turned toward the front side (toward the left hand side in FIG. 2) of the multifunction device 10 so as to extend toward the front side. The conveyance path 23 extends to the sheet discharging tray 21 through a recording section 24 (see FIG. 1).

As shown in FIG. 2, a sheet feeding roller 25 is located above the sheet feeding tray 20. The sheet feeding roller 25 is brought into contact with the uppermost recording sheet 50 in the sheet feeding tray 20 with pressure and supplies the recording sheet 50 to conveyance path 23. The sheet feeding roller 25 is rotatably supported at the front end of an arm 26. The arm 26 can swing around a pivot 28 so as to move toward or away from the sheet feeding tray 20. The arm 26 is urged to rotate toward the sheet feeding tray 20 by the own weight or by a spring. Drive force is transmitted from an LF motor 85 (see FIG. 4) to the sheet feeding roller 25 via a drive transmission mechanism disposed on the arm 26. With the above-described structure, a recording sheet 50 is supplied from the sheet feeding tray 20 to the conveyance path 23.

As shown in FIG. 2, the recording section 24 is located on the conveyance path 23. The recording section 24 records an image on the recording sheet 50 that is conveyed along the conveyance path 23. Here, the recording sheet 50 is conveyed to a conveyance direction 17 that is substantially a rear-to-front direction when the recording sheet is located at the recording section 24. The recording section 24 has a carriage 38 and the recording head 39. The ink cartridges (not shown) are mounted to the multifunction device 10 by opening a cover 87 (see FIG. 1). Predetermined colors of ink are supplied to the recording head 39 from the ink cartridges (not shown).

The carriage 38 is capable of reciprocating in a direction substantially orthogonal to the conveyance direction 17 of the recording sheet 50 (i.e., the direction perpendicular to the drawing sheet of FIG. 2, which is also referred to a main scanning direction, hereinafter). The carriage 38 is driven to reciprocate at a predetermined timing by a belt drive mechanism that is well-known in the art. The recording head 39 and a medium sensor 47 are mounted in the carriage 38. Thus, the recording head 39 and the medium sensor 47 reciprocate with the carriage 38. The configuration of the medium sensor 47 will be described in detail later.

[Recording Head]

Figure 3:
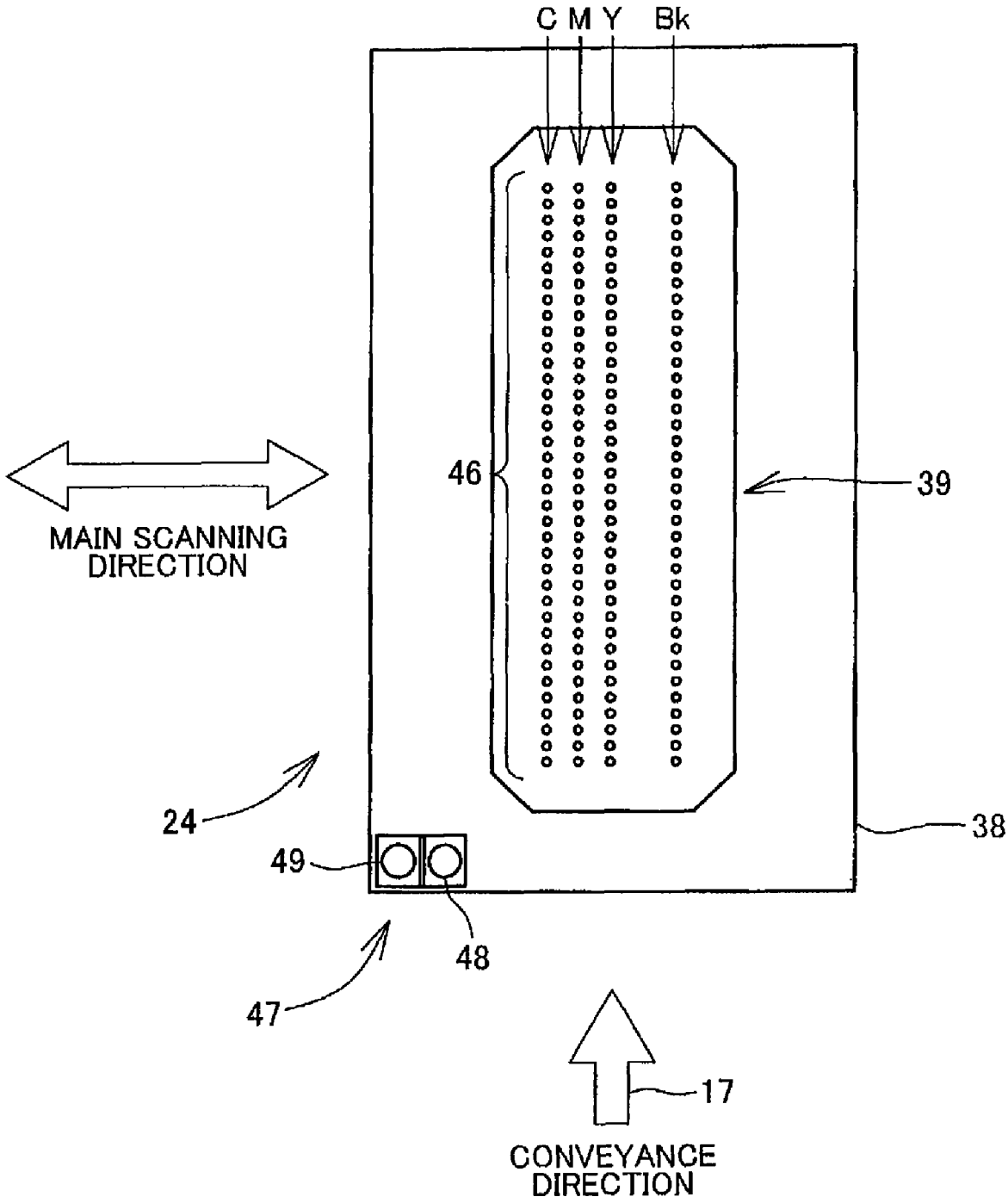
FIG. 3 is a bottom view of a recording head.

FIG. 3 is a bottom view of the recording section 24. When the carriage 38 is driven to reciprocate in the main scanning direction, the recording head 39 (see FIGS. 2 and 3) records an image on the recording sheet 50 by ejecting ink onto the recording sheet 50, which is being conveyed along the conveyance path 23. As shown in FIG. 3, the recording head 39 has a plurality of nozzles 46 arranged at the bottom surface thereof (the lower side in FIG. 2). The recording head 39 ejects ink from the nozzles 46 in an ink-jet method. The nozzles 46 for each ink of the colors, cyan (C), magenta (M), yellow (Y) and black (Bk), are arranged along the conveyance direction 17 of the recording sheet 50. Inks of C, M, Y and Bk are supplied to the recording head 39 from the respective ink cartridges via ink tubes (not shown). The supplied inks of the different colors are distributed to the corresponding nozzles 46 via the respective flow channels formed in the recording head 39. When the carriage 38 is driven to reciprocate, ink droplets are selectively ejected from the recording head 39 onto the recording sheet 50 that is being conveyed along the conveyance path 23. As a result, an image is recorded on the recording sheet 50 that is conveyed on the platen 42. In this embodiment, the image recording process is executed based on the printing data that a control unit 100 of the multifunction device 10 receives from the terminal device 70.

[Conveyance Section]

In this embodiment, the multifunction device 10 further includes a conveyance section that conveys the recording sheet 50. The conveyance section includes a conveyance roller 60, a pinch roller 31, a sheet discharging roller 62, a spur roller 63, the LF motor 85 (see FIG. 4) and a drive circuit 81 (see FIG. 4). As shown in FIG. 2, the conveyance roller 60 is located upstream of the recording section 24 in the conveyance direction 17 (hereinafter, referred to as "upstream side") on the conveyance path 23. The pinch roller 31 is located at a position opposite to the conveyance roller 60 across the conveyance path 23. That is, the conveyance path 23 is interposed between the conveyance roller 60 and the pinch roller 31. The pinch roller 31 is urged toward the conveyance roller 60 so as to contact the conveyance roller with pressure. The recording sheet 50 supplied into the conveyance path 23 proceeds to a nip position between the conveyance roller 60 and the pinch roller 31. The conveyance roller 60 and the pinch roller 31 pinch the recording sheet 50 and feed the recording sheet 50 onto the platen 42 as the conveyance roller 60 and the pinch roller 31 are driven to rotate.

More specifically, the conveyance roller 60 and the pinch roller 31 repeat a first action to feed the recording sheet 50 onto the platen 42. In the first action, the conveyance roller 60 and the pinch roller 31 convey the recording sheet 50 by a unit feeding distance. When a leading edge of the recording sheet 50 is located at the nip position of the conveyance roller 60 and the pinch roller 31, the control unit 100 (see FIG. 4) drives the conveyance roller 60 to intermittently rotate by an amount of rotation that corresponds to the unit feeding distance. The unit feeding distance is equal to a line feed amount for sequentially recording an image line by line on the recording sheet 50 by the recording head 39. In other words, while the recording sheet 50 is pinched between the conveyance roller 60 and the pinch roller 31, the recording sheet 50 is conveyed by a length equal to the line feed amount below the recording head 39. In accordance with the conveyance by the line feed amount, the control unit 100 drives the recording head 39 to scan in the main scanning direction (the direction perpendicular to the drawing sheet of FIG. 2) and controls the recording head 39 to eject ink in order to record an image on the recording sheet 50. Thus, an image recording operation and the conveyance of the recording sheet 50 by the unit feeding distance are repeated alternately. Then, an image is recorded sequentially on the entire surface of the recording sheet 50.

As shown in FIG. 2, the sheet discharging roller 62 is located downstream of the recording section 24 in the conveyance direction 17 (hereinafter, referred to "downstream side") on the conveyance path 23. The spur roller 63 is located opposing to the sheet discharging roller 62 with the conveyance path 23 interposed therebetween. The spur roller 63 is urged toward the sheet discharging roller 62 to contact the sheet discharging roller 62 with pressure. The spur roller 63 contacts the recording surface of the recording sheet 50 with pressure. The spur roller 63 has spur-like projections on a roller surface thereof in order not to deteriorate the image recorded on the recording sheet 50. The sheet discharging roller 62 and the spur roller 63 rotate while pinching the part of recording sheet 50 therebetween, which passed the platen 42. Then, the recording sheet 50 is discharged from the conveyance path 23 onto the sheet discharging tray 21.

The conveyance roller 60 and the sheet discharging roller 62 rotate by the drive force from the LF motor 85 (see FIG. 4) and move the recording sheet 50 forward along the conveyance path 23. Thus, the conveyance roller 60 and the sheet discharging roller 62 are intermittently driven to rotate by the amount of rotation that corresponds to the line feed amount. The rotation of the conveyance roller 60 is synchronized with the rotation of the sheet discharging roller 62.

As shown in FIG. 2, a register sensor 71 is located upstream of the conveyance roller 60 and the pinch roller 31 in the conveyance direction 17 on the conveyance path 23. The register sensor 71 is configured to detect the presence or absence of a recording sheet 50 that is conveyed along the conveyance path 23. In the embodiment, the register sensor 71 is a mechanical sensor. The register sensor 71 includes a photo interrupter and a feeler rotatably supported by a pivot. The photo interrupter includes a light emitting section for emitting light toward the feeler and a light receiving section for receiving reflected light from the feeler. The register sensor 71 outputs a sensor signal (for example, an electric signal representing the luminance) based on the luminance of light received by the light receiving section of the photo interrupter. As the recording sheet 50 reaches a position P1, the recording sheet 50 contacts the feeler and the feeler rotates. Here, the position P1 is the position where the register sensor 71 is located on the conveyance path 23. Because of the rotation of the feeler, the sensor signal output from the register sensor 71 changes. Accordingly, the control unit 100 can detect the presence of the recording sheet 50 according to the change of the sensor signal output from the register sensor 71.

Figure 4:
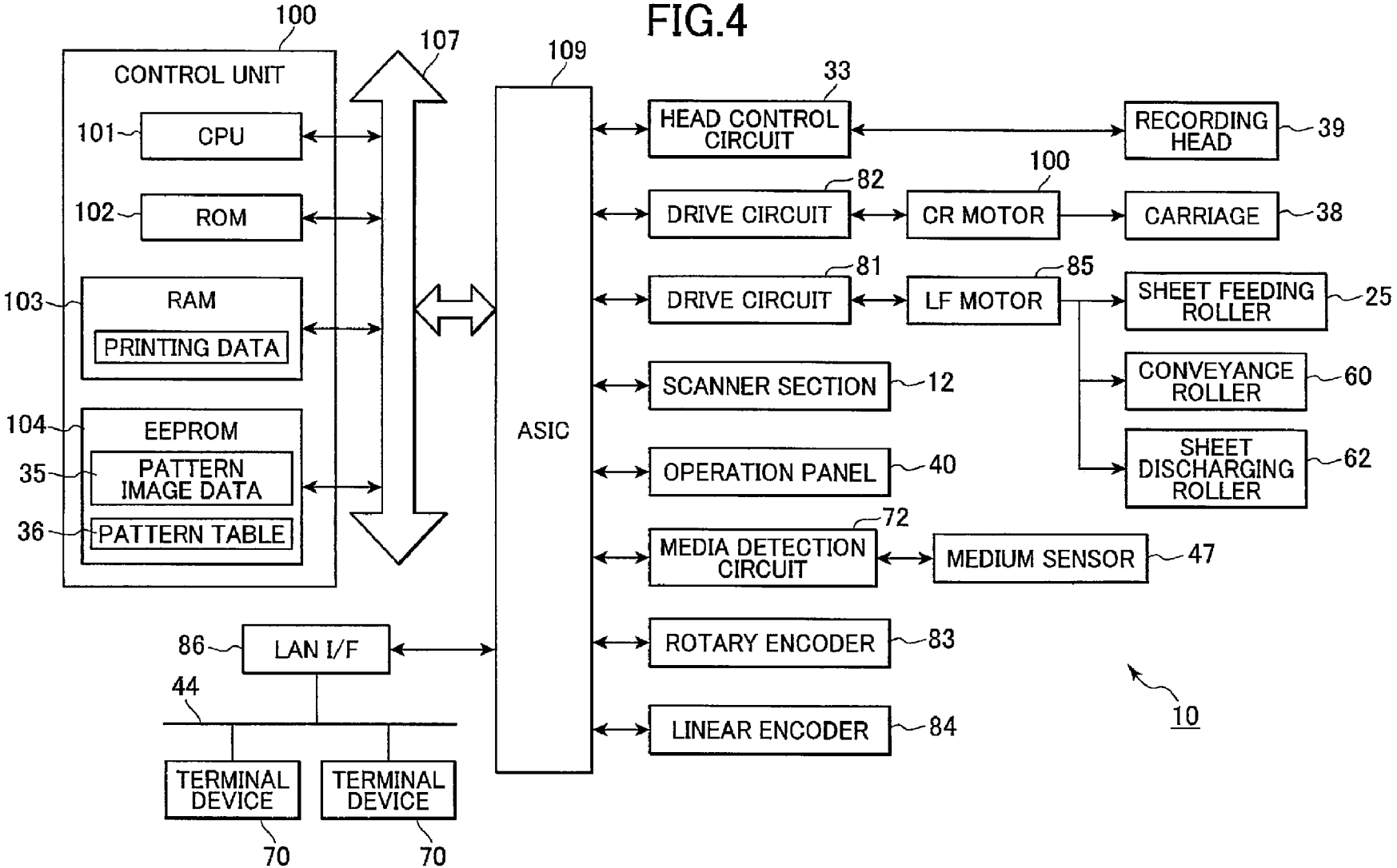
FIG. 4 is a block diagram of the multifunction device.

FIG. 4 is a block diagram of the multifunction device 10 according to the embodiment. The control unit 100 controls the overall operation of the multifunction device 10. As shown in FIG. 4, the control unit 100 is configured by a microcomputer including a CPU (central processing unit) 101, a ROM (read only memory) 102, a RAM (random access memory) 103, an EEPROM (electrically erasable and programmable ROM) 104 as principal components thereof. The control unit 100 is connected to an ASIC (application specific integrated circuit) 109 via a bus 107.

The ROM 102 stores various programs to be used by the CPU 101 that controls various operations of the multifunction device 10. The RAM 103 serves as a storage area or a workspace for temporarily storing various data to be used by the CPU 101 when the CPU 101 executes the above programs. The RAM 103 temporarily stores the printing data received from the terminal device 70.

The printing data is image data of the RGB format (the RGB color coordinate system) including data for the three color components of red (R), green (G) and blue (B). The printing data are multi-valued color image data and each of the color components of RGB is expressed typically by 8 bits (256 tones). The printing data of the RGB format are converted into printing data of the CMYBk format having four color components of cyan (C), magenta (M), yellow (Y) and black (Bk). The recording head 39 operates for recording an image according to the printing data converted into the CMYBk format.

The EEPROM 104 stores settings and flags that need to be held after the power source is turned off. In this embodiment, pattern image data 35 and a pattern table 36 are stored in the EEPROM 104. The pattern image data 35 and the pattern table 36 will be described in detail later.

The ASIC 109 is connected to a head control circuit 33, a drive circuit 81, a drive circuit 82, the scanner section 12 (see FIG. 1), the operation panel 40 (see FIG. 1), an media detection circuit 72, a rotary encoder 83, a linear encoder 84, and a LAN I/F (local area network interface) 86.

The LAN I/F 86 is for connecting the LAN 44 and the multifunction device 10 so that the multifunction device 10 can establish communications via the LAN 44. The multifunction device 10 is connected to the plurality of terminal devices 70 via the LAN 44 to communicate therewith. The control unit 100 receives the printing data transmitted from each of the terminal devices 70.

The head control circuit 33 drives the recording head 39 based on the printing data of the CMYBk format input from the ASIC 109. The different colors of ink are selectively ejected from the nozzles 46 (see FIG. 3) of the recording head 39 at a predetermined timing to record an image on the recording sheet 50. The head control circuit 33 is mounted in the carriage 38 (see FIG. 2) with the recording head 39 and the medium sensor 47.

The drive circuit 82 (part of the drive mechanism) applies a drive signal to a CR motor 80 based on a phase excitation signal input from the ASIC 109. Upon receiving the drive signal, the CR motor 80 (part of the drive mechanism) rotates to control the reciprocation of the carriage 38.

As shown in FIG. 2, the drive circuit 81 drives the LF motor 85. The LF motor 85 is connected to the sheet feeding roller 25, the conveyance roller 60, and the sheet discharging roller 62. Upon receiving the output signal from the ASIC 109, the drive circuit 81 drives the LF motor 85. The drive force of the LF motor 85 is selectively transmitted to the sheet feeding roller 25, the conveyance roller 60 and the sheet discharging roller 62 via a well-known drive mechanism including gears and drive shafts.

The rotary encoder 83 measures the rotation of the conveyance roller 60 and detects the conveyed distance (conveyance distance) of the recording sheet 50. As shown in FIG. 2, an encoder disk 19 and a photo sensor 73 are arranged at the conveyance roller 60. The encoder disk 19 is a transparent disk that rotates with the conveyance roller 60. The encoder disk 19 has marks that are provided in a radial arrangement at a predetermined pitch. The encoder disk 19 is fixed to the shaft of the conveyance roller 60 and rotates with the conveyance roller 60. The photo sensor 73 includes a light emitting element and a light receiving element. The photo sensor 73 is located at a position adjacent to the conveyance roller 60. The photo sensor 73 is located in such a way that a peripheral edge of the encoder disk 19 is located in the space between the light emitting element and the light receiving element.

The rotary encoder 83 detects an amount of rotation of the encoder disk 19 by counting the number of marks of the encoder disk 19 based on a result of detection by the photo sensor 73. Since the conveyance roller 60 is driven to rotate with the encoder disk 19, the rotation of the conveyance roller 60, that is, the conveyed distance of the recording sheet 50 can be detected by detecting the amount of rotation of the encoder disk 19. Based on the result of detection of the rotary encoder 83, the control unit 100 controls the LF motor 85 that drives the conveyance roller 60 to rotate.

The linear encoder 84 detects the traveling distance of the carriage 38 that reciprocates in the main scanning direction. Since the medium sensor 47 is mounted in the carriage 38, the linear encoder 84 can detect the position of the medium sensor 47 with respect to the recording sheet 50 in the main scanning direction. Although not shown in the drawings, an encoder strip is arranged in the reciprocating direction of the carriage 38. The linear encoder 84 detects the encoder strip by the photo interrupter mounted in the carriage 38. The control unit 100 detects the position of the medium sensor 47 mounted in the carriage 38 and controls the rotation of the CR motor 80 based on the result of detection of the linear encoder 84.

The medium sensor 47 optically detects the perforation 15 pre-formed in the recording sheet 50 that is conveyed along the conveyance path 23. As shown in FIGS. 2 and 3, the medium sensor 47 of the embodiment is mounted in the carriage 38. Thus, the medium sensor 47 can reciprocate in the main scanning direction. As shown in FIG. 2, the medium sensor 47 is located upstream (at the right hand side in FIG. 2) of the recording head 39 in the conveyance direction 17. The medium sensor 47 detects a leading edge and side edges (left edge and right edge) of the recording sheet 50 on the platen 42 and is also employed to detect the perforation 15 pre-formed in the recording sheet 50.

The media detection circuit 72 eliminates noise from the detection signal (electric signal) from the medium sensor 47 and outputs the detection signal to a predetermined destination (for example, the control unit 100). The control unit 100 detects the arrival of the recording sheet 50 onto the platen 42 that is conveyed along the conveyance path 23, based on the detection signal output from the media detection circuit 72, and also detects the perforation 15 pre-formed in the recording sheet 50.

Figure 5A:
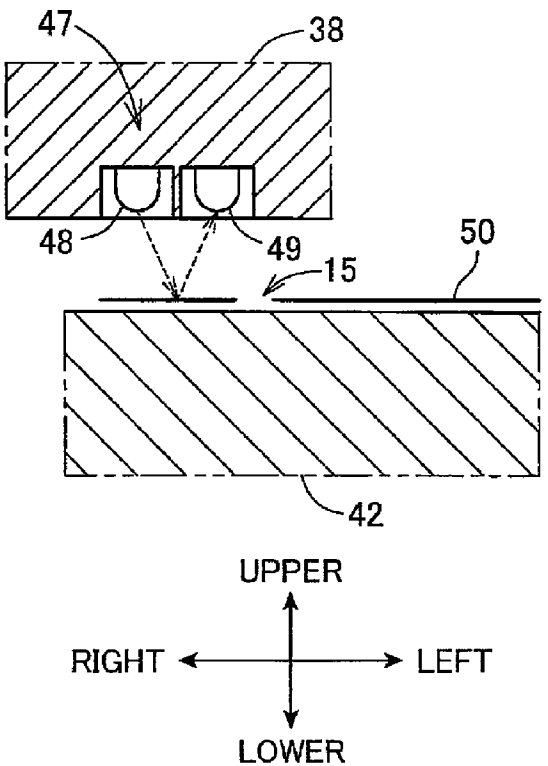
FIG. 5(A) is an enlarged schematic cross-sectional view of a medium sensor where a recording surface of a recording sheet is located below the medium sensor.
Figure 5B:
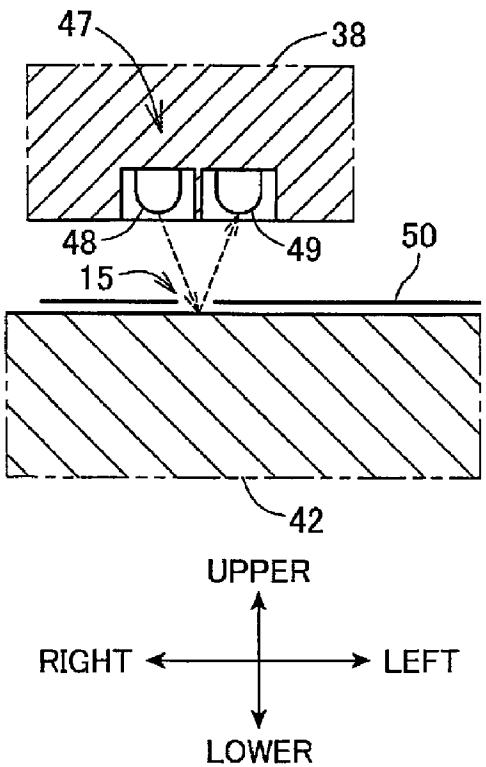
FIG. 5(B) is an enlarged schematic cross-sectional view of the medium sensor that moves just above a perforation formed in the recording sheet from the position shown in FIG. 5(A)
Figure 5C:
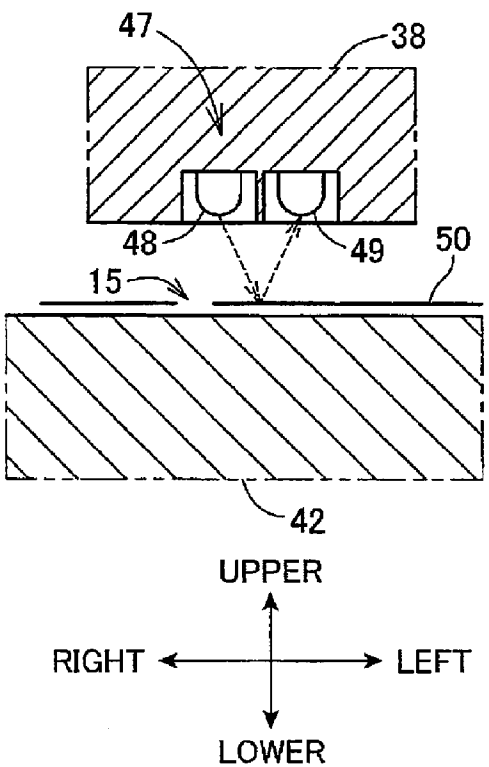
FIG. 5(C) is an enlarged schematic cross-sectional view of the medium sensor that further moves in a main scanning direction from the position shown in FIG. 5(B)

FIGS. 5(A)-5(C) are enlarged schematic cross-sectional views of the medium sensor 47, showing the configuration thereof, and illustrating how the medium sensor 47 is moved in the main scanning direction.

As shown in FIGS. 5(A)-5(C), the medium sensor 47 includes a light emitting section 48 including a light emitting diode and a light receiving section 49 including an optical sensor. The light emitting section 48 irradiates light in a subsequently downward direction. The light receiving section 49 receives light reflected by the platen 42 or the recording sheet 50. The medium sensor 47 outputs, to the media detection circuit 72 (see FIG. 4), a detection signal according to the luminance of light received by the light receiving section 49.

The top surface of the platen 42 is colored in a darker color that has a reflectance lower than the recording sheet 50.

FIG. 5(A) illustrates that the recording surface of the recording sheet 50 is located right below the medium sensor 47. As shown in FIG. 5(A), the light receiving section 49 receives reflected light from the recording sheet 50 that has a reflectance higher than the platen 42. Thus, the detection signal output from the medium sensor 47, to be more specific, the media detection circuit 72, has a high value.

FIG. 5(B) illustrates that the carriage 38 is moved in the main scanning direction (the right-to-left direction in FIG. 5(B)) and the perforation 15 pre-formed in the recording sheet 50 is located just below the medium sensor 47. As shown in FIG. 5(B), the light receiving section 49 receives, through the perforation 15, reflected light from the platen 42 having a reflectance lower than the recording sheet 50. Thus, the detection signal output from the media detection circuit 72 has a low value.

FIG. 5(C) illustrates that the carriage 38 is moved further from the position as shown in FIG. 5(B) and the recording surface of the recording sheet 50 is located just below the medium sensor 47. As shown in FIG. 5(C), the light receiving section 49 receives reflected light from the recording sheet 50 having a reflectance higher than the platen 42 as in FIG. 5(A). Thus, the detection signal output from the medium detection circuit 72 has a high value.

As described above, the signal intensity of the detection signal output from the medium detection circuit 72 changes according to the luminance of light that the light receiving section 49 receives. Thus, the control unit 100 can determine whether the recording sheet 50 has perforations 15 or not based on the detection signal output from the media detection circuit 72. Since the medium sensor 47 is configured to reciprocate in the main scanning direction, the medium sensor 47 can check the entire area of the recording sheet 50 to detect perforation 15.

The medium sensor 47 can detect the edges 53 of the recording sheet 50 with respect to the main scanning direction (the side edges with respect to the main scanning direction, that is, the left edge or the right edge; see FIG. 8). The medium sensor 47 can also detect that the leading edge of the recording sheet 50 (the downstream side edge with respect to the conveyance direction) is conveyed on the platen 42.

The media detection circuit 72 outputs the detection signal to a predetermined output destination (for example, the control unit 100) while the medium sensor 47 (the carriage 38) is driven to reciprocate. The control unit 100 detects the width of the perforations 15 in the main scanning direction based on the detection signal.

As the perforation 15 is detected according to the detection signal, the conveyance roller 60 and the sheet discharging roller 62 repeat a second action. In the second action, the recording sheet 50 is conveyed by a predetermined feeding distance S (see FIGS. 6 and 7). The predetermined feeding distance S is defined that the recording sheet 50 is not conveyed beyond the above-described unit feeding distance if the second action is repeated for a number of times. No ink is ejected from the recording head 39 while the second action is repeated. In other words, by repeating the second action, the recording sheet 50 is conveyed intermittently by the predetermined feeding distance S.

The media detection circuit 72 outputs a detection signal while the carriage 38, that is, the medium sensor 47 are driven to reciprocate in the main scanning direction. When a perforation 15 is positioned below the medium sensor 47, the signal intensity of the detection signal output from the media detection circuit 72 changes. More specifically, the detection signal changes while the medium sensor 47 is moving, in the main scanning direction, above the perforation 15. As shown in FIGS. 5(A) and 5(B), while the medium sensor 47 moves from directly above the recording sheet 50 (FIG. 5(A)) to directly above the perforation 15 (FIG. 5(B)), the detection signal output from the media detection circuit 72 changes from the high value to the low value. As shown in FIGS. 5(B) and 5(C), while the medium sensor 47 moves from directly above the perforation 15 (FIG. 5(B)) to directly above the recording surface of the recording sheet 50 (FIG. 5(C)), the detection signal output from the media detection circuit 72 changes from the low value back to the high value. The control unit 100 detects the width of the perforations 15 in the main scanning direction based on the result of detection of the linear encoder 84 while the detection signal output from the media detection circuit 72 changes. More specifically, the control unit 100 determines, as a width of perforation 15, a moving distance of the carriage 38 between a point of the carriage 38 at a time when an edge of a perforation 15 in the main scanning direction is firstly detected, and a point of the carriage 38 at a time when another edge of the perforation 15 is secondly detected based on the result of detection of the linear encoder 84. The control unit 100 determines, as a width of perforation 15, a moving distance of the carriage 38 between a point of the carriage 38 at a time when the detection signal output from the media detection circuit 72 changes from the high value to the low value, and a point of the carriage 38 when the detection signal output from the media detection circuit 72 changes from the low value to the high value. Since the width of the perforation 15 is detected, the control section 100 can determine the size of the perforation 15 that is formed in the recording sheet 50.

The control unit 100 determines, as a position of perforation 15 in the main scanning direction, a moving distance of the carriage 38 between a point of the carriage 38 at a time when the right edge of the recording sheet 50 is detected and a point of the carriage when the left edge of the perforation is detected in one scanning of the carriage 38. The control unit 100 determines, as a position of perforation 15 in the conveyance direction 17, a conveying distance of the recording sheet 50 between a time when a leading edge of the recording sheet 50 is detected and a time when a first perforation is detected.

The process by which the detected perforation 15 is determined to be round perforation or angular (square or rectangular) perforation will be described below.

The second action is started when the width of the perforations 15 in the main scanning direction is determined. More specifically, the conveyance roller 60 and the sheet discharging roller 62 are driven to rotate and the recording sheet 50 is conveyed by the predetermined feeding distance S. Then, the control unit 100 performs the process of detecting the width of the perforation 15 once again. In other words, as one perforation 15 is detected, the process of detecting the width of the perforation 15 in the main scanning direction and the second action are repeated alternately.

Figure 6:
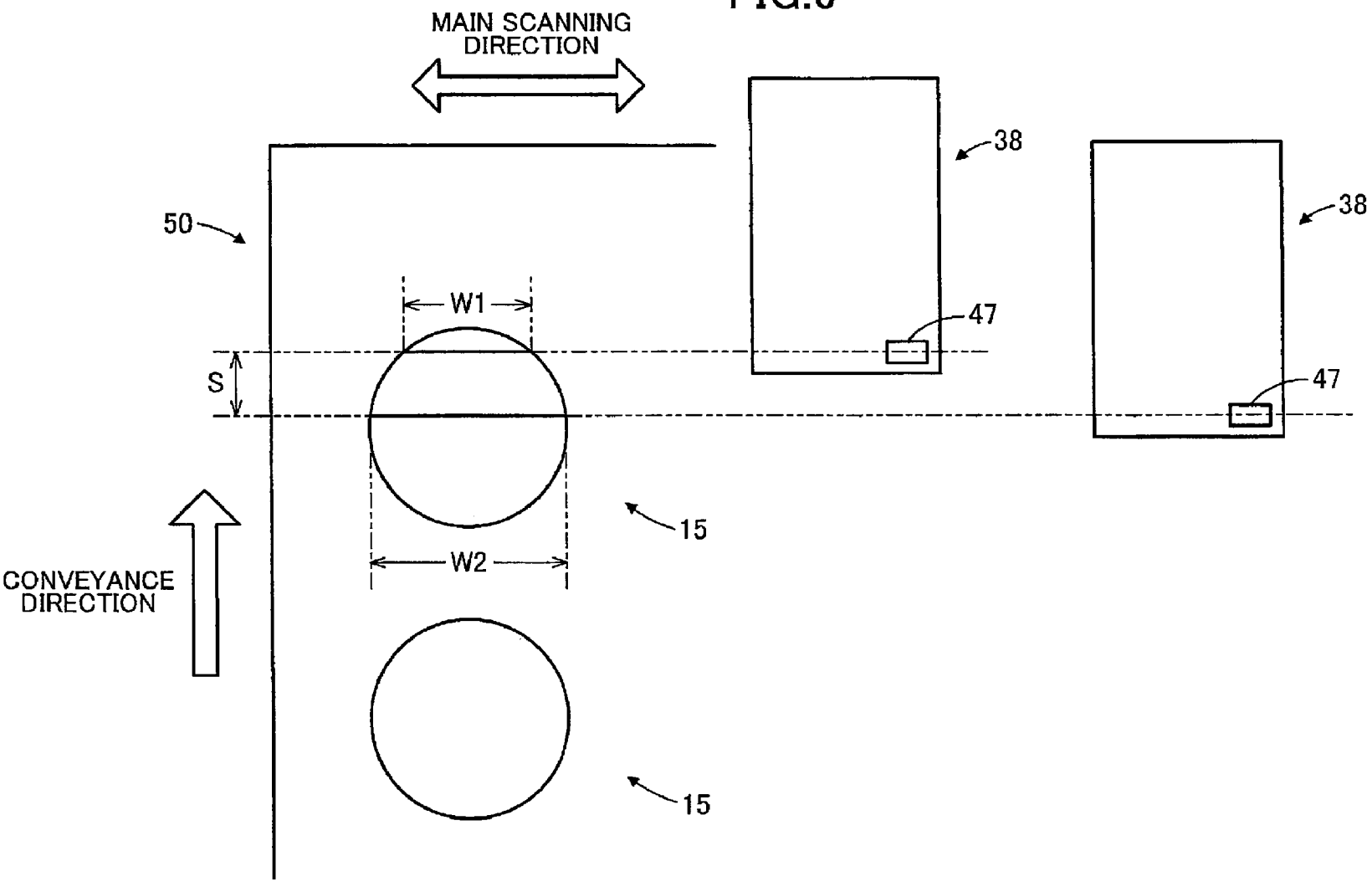
FIG. 6 schematically illustrates a process of detecting the perforation that is executed when the perforation 15 is round shape.
Figure 7:
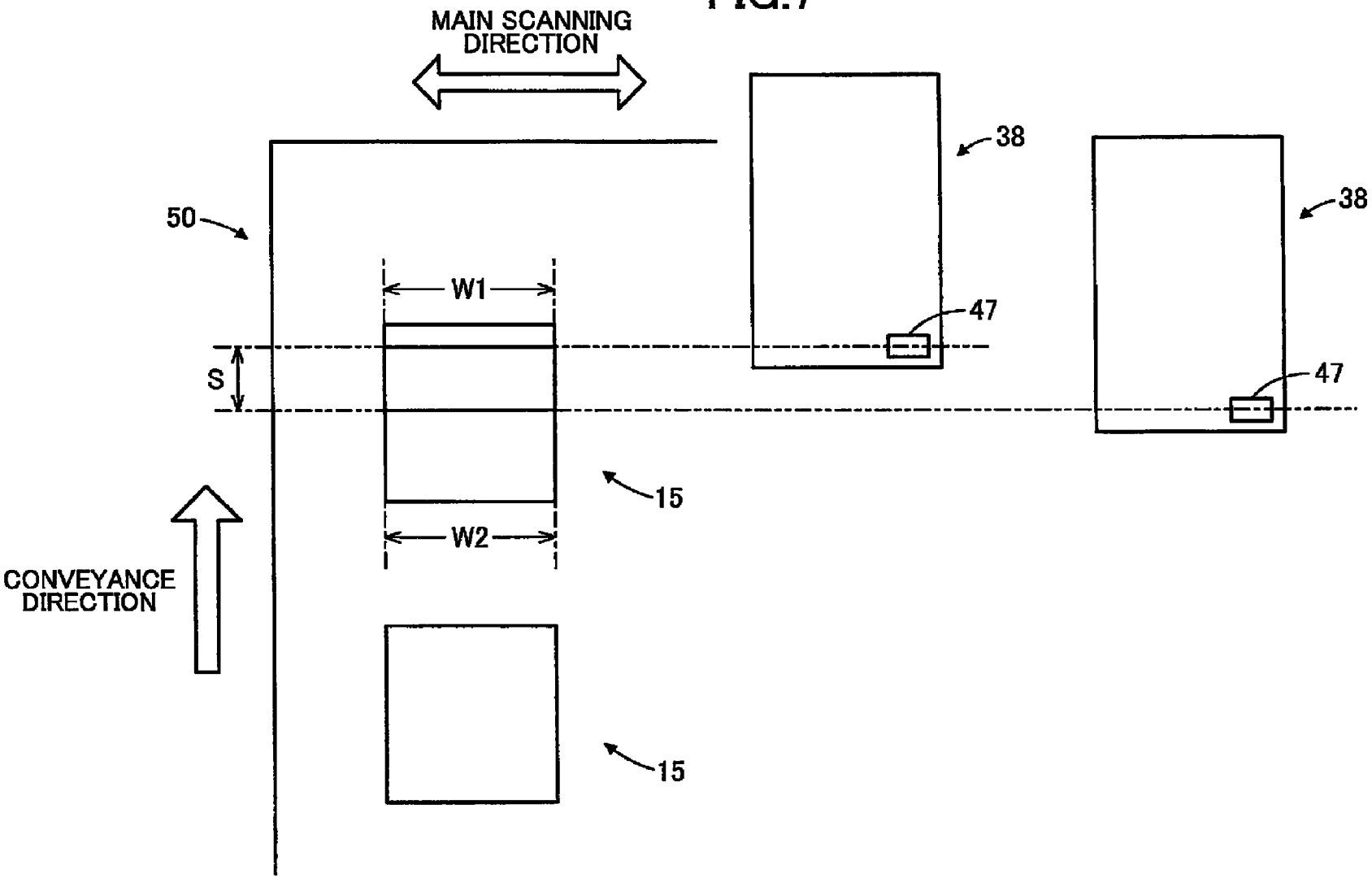
FIG. 7 schematically illustrates a process of detecting the perforation that is executed when the perforation is angulated (tetragonal) shape.
Figures 8A, 8B, 8C, 8D:
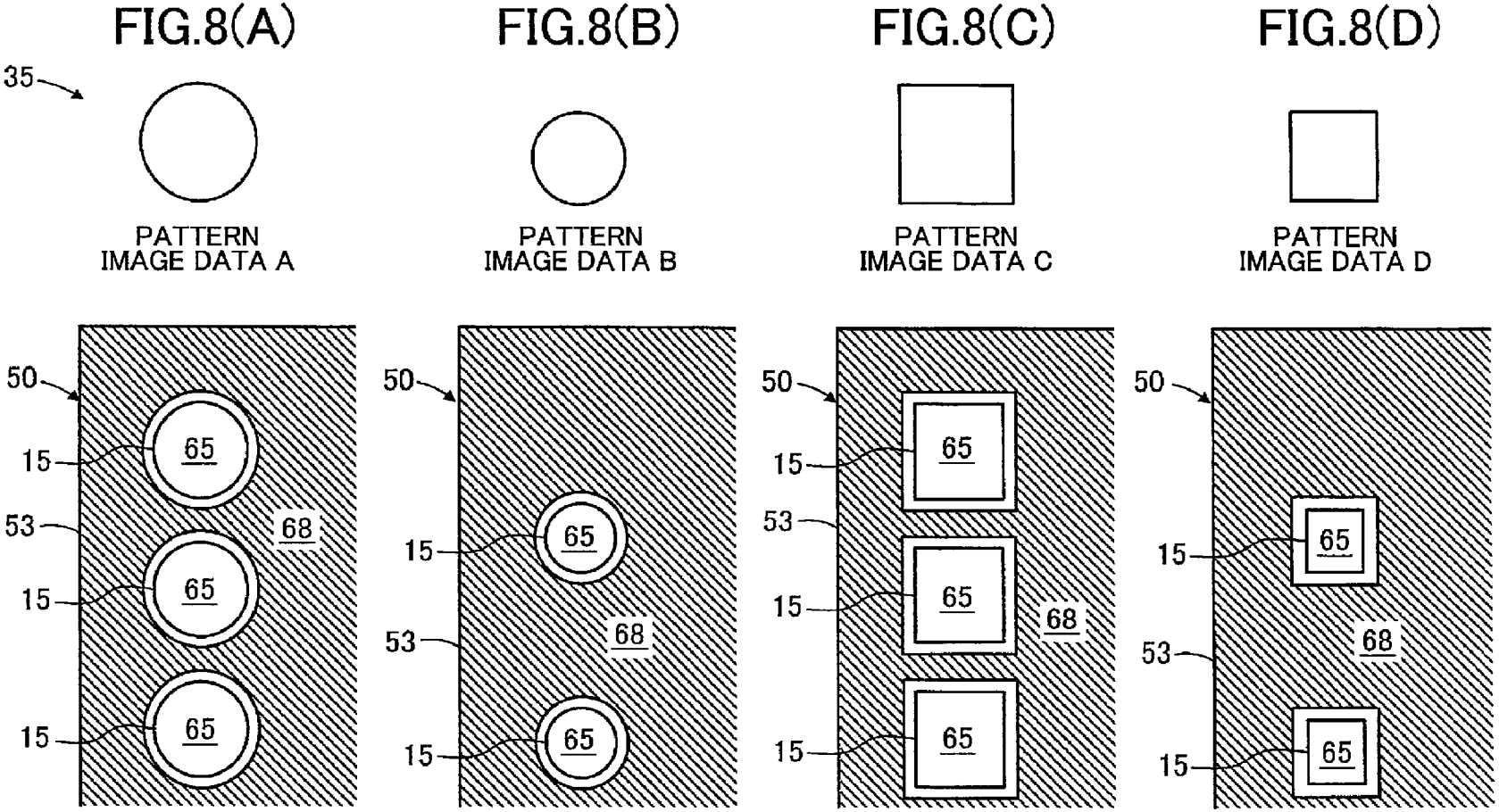
FIG. 8(A) schematically illustrates the process of borderless printing an image on a recording sheet formed with a large and round shaped perforation.
FIG. 8(B) schematically illustrates a process of borderless printing an image on a recording sheet formed with a small and round shaped perforation.
FIG. 8(C) schematically illustrates the process of borderless printing an image on a recording sheet formed with a large and angulated shaped perforation.
FIG. 8(D) schematically illustrates the process of borderless printing an image on a recording sheet formed with a small and angulated shaped perforation.

FIG. 6 schematically illustrates the process of detecting perforations 15 that is executed when the perforation 15 pre-formed in the recording sheet 50 has a round shape. FIG. 7 schematically illustrates the process of detecting perforations 15 that is executed when the perforation 15 pre-formed in the recording sheet 50 has an angular (tetragonal) shape.

As shown in FIG. 6, when the perforation 15 has a round shape, a width W1 of the perforation 15 detected before the second action is performed changes to a width W2 detected after the second action is performed. That is, the width W2 is broader than the width W1. In other words, the width of the perforation 15 varies between before and after the second action. As shown in FIG. 7, when the perforations 15 pre-formed in the recording sheet 50 has an angular shape, a width W3 of the perforation 15 detected before the second action is substantially equal to a width W4 detected after the second action. That is, the widths of the perforation 15 detected before and after the second action are substantially equal to each other. The control unit 100 determines whether the width of the perforation 15 with respect to the main scanning direction, which is detected while the second action is repeated, changes or not. Based on this determination whether the width of the perforation 15 changes or not, the control unit 100 can determine whether the perforation 15 has a round shape or an angular shape. While the angular perforation is tetragonal perforation in the embodiment, perforation that can be used is not limited to tetragonal perforations. For example, the angular perforation may be any polygonal perforation so long as they have two sides extending in parallel with the conveyance direction 17.

The process of specifying the position of the perforation 15 pre-formed in the recording sheet 50 will be described below.

As described above, the position of the medium sensor 47 with respect to the recording sheet 50 in the main scanning direction can be determined on the basis of the result of the detection of the linear encoder 84. The conveyed distance of the recording sheet 50 can be determined on the basis of the result of the detection of the rotary encoder 83. The perforation 15 pre-formed in the recording sheet 50 can be detected based on the detection signal output from the medium sensor 47 (media detection circuit 72). Accordingly, the control unit 100 can specify the position of the perforation 15 on the recording sheet 50 with respect to the main scanning direction based on the position of the medium sensor 47 when the perforation 15 is detected. The control unit 100 can specify the position of the perforation with respect to the conveyance direction 17 based on the conveyed distance of the recording sheet 50 from a position of the recording sheet 50 at a time when the leading edge of the recording sheet 50 is detected by the medium sensor 47 to a position of the recording sheet 50 at a time when the perforation 15 is detected by the medium sensor 47. Thus, the control unit 100 detects the position of the perforation 15 in the recording sheet 50 based on the detection signal output from the medium sensor 47 (the media detection circuit 72), the result of the detection of the linear encoder 84, and the result of the detection of the rotary encoder 83.

FIGS. 8(A)-8(D) schematically illustrate the borderless printing process of an image on a recording sheet 50 having perforations 15. As shown in FIGS. 8(A)-8(D), the recording sheet 50 has first regions 65 and a second region 68.

For example, when the terminal device 70 instructs to start a borderless printing process by transmitting image data, a recording sheet 50 is supplied from the sheet feeding tray 20 and conveyed along the conveyance path 23. When the leading edge of the recording sheet 50 reaches the platen 42, the carriage 38 is driven to start reciprocating. The control unit 100 executes the process of detecting perforation 15 pre-formed in the recording sheet 50 based on the detection signal output from the media detection circuit 72 while the carriage 38 is driven to reciprocate. As the perforation 15 pre-formed in the recording sheet 50 is detected, the control unit 100 prohibits the recording head 39 from ejecting ink onto the first regions 65 of the recording sheet 50 and controlling the recording head 39 to eject ink onto the second region 68.

Each of the first regions 65 is a region that includes at least a perforation 15. For the embodiment, each of the first regions 65 is homothetic to and larger than a region of the perforation 15 (see FIGS. 8(A)-8(D)). Since the control unit 100 can determine the size of each of the perforations 15 based on the width of the detected perforation 15, the control unit 100 can define the area of the first region 65 based on the result of the determination. For example, the area of the first region 65 may be determined to be about 110% to 140% of the area of the perforation 15.

As shown in FIGS. 8(A)-8(D), for the embodiment, the second region 68 is all the area of the recording surface of the recording sheet 50 except the first regions 65. In other words, the second region 68 includes the center region (the inside region with respect to the perforations 15) of the recording sheet 50. The second region 68 also includes the region between two adjacent perforations 15. Where one of the two adjacent perforations 15 is included in one first region 65, and another one of the two adjacent perforation 15 is included in another one first region 65. In other words, the second region 68 includes part of the straight line connecting the centers of the two adjacent perforations 15. The second region 68 also includes the region between the first region 65 and the edge 53 of the recording sheet 50, which is closest to the first regions 65. The edge of the recording sheet 50 that is closest to the first regions 65 is not limited to the left edge of the recording sheet 50 (see FIGS. 8(A)-8(D)). That is, when the first regions 65 are closest not to the edge 53 but to the leading edge or the tailing edge of the recording sheet 50, the second region 68 may include the region between the first region 65 and the leading edge or the trailing edge.

The recording head 39 ejects ink onto the second region 68 without ejecting ink onto the first regions 65 to perform borderless printing of an image on the recording sheet 50. For the borderless printing, the control unit 100 executes the process as described below. Here, in the borderless printing of the embodiment, the image is recorded with no margin with respect to the edges of the recording sheet 50.

The control unit 100 substitutes the image data of a predetermined pattern (which is the pattern image data 35 as shown in one of FIGS. 8(A)-8(D)) for the printing data to be recorded on each of the first regions 65. In other words, the pattern image data 35 of the embodiment is one of a pattern image data A, a pattern image data B, a pattern image data C and a pattern image data D. Both the pattern image data A and the pattern image data B are circular images having different sizes, while the pattern image data C and the pattern image data D are rectangular images having different sizes. The circle of the pattern A is larger in size than the circle of the pattern B, while the rectangle of the pattern C is larger in size than the rectangle of the pattern D. The pattern image data 35 are formed by white pixel data (pixel data for a blank area). The white pixel data are pixel data having predetermined color specification values for white (for example, R, G and B=255, 255 and 255).

As described above, the control unit 100 can determine the shape and the size of each of the perforations 15 pre-formed in the recording sheet 50. The control unit 100 selects the pattern image data A, the pattern image data B, the pattern image data C or the pattern image data D for the pattern image data 35 based on the result of the determination. That is, the control unit 100 defines the first regions 65 based on the position of the perforations 15 specified from the result of detection of the linear encoder 84 and the rotary encoder 83. Then, the control unit 100 specifies parts of the printing data corresponding to the first regions 65 from the printing data stored in the RAM 103. That is, the part of the printing data corresponds to parts of the image that is originally planned to be recorded on a region of the first region 65 and the perforation 15. The control unit 100 then substitutes the selected pattern image data 35 for each of the specified parts of the printing data. Then, the recording head 39 records an image based on the printing data where the parts of the printing data corresponding to the first regions 65 are substituted by the selected pattern image data 35. Since the pattern image data 35 are formed by white pixel data, no ink is ejected onto the first regions 65 of the recording sheet 50 from the recording head 39. Thus, the ink ejected from the recording head 39 is prevented from passing through any of perforations 15.

The pixel data representing a blank area is not limited to white pixel data so long as the pixel data prevents ink from being ejected from the recording head 39 onto the first regions 65. Pixel data representing a blank area may be pixel data having no color system values.

A recording sheet formed with perforation is typically used in loose leaf notebooks and day planners. The perforation mostly conforms to standards with respect to a shape of perforations, a size of perforations 15 and positions where perforations 15 is located in the recording sheet 50. The EEPROM 104 stores the pattern table 36. The pattern table 36 stores information on the shape of perforations 15, the size of perforations 15 and the positions where perforations 15 are located in the recording sheet 50 in association with standardized sizes of recording sheet 50.

FIG. 9 is a schematic illustration of a pattern table 36. As shown in FIG. 9, the pattern table 36 has six fields including a "recording sheet size" field, a "position" field, a "shape" field, a "size" field, a "number of perforations" field and a "pattern" field. The EEPROM 104 stores the pattern table 36 so that information about one field is associated with information about another field. For example, information "A4" in the "recording sheet size" field, "(X1, Y1)" in the "position" field, "round" in the "shape" field, "large" in the "size" field, "2" in the "number of perforations" field, "A" in the "pattern" field are associated with each other. The information stored for each of the fields will be described below.

The "recording sheet size" field stores standardized sizes of recording sheets 50 having perforations 15. The standardized sizes include the A4 size (297 mm×210 mm), the B5 size (257 mm×182 mm), the A5 size (210 mm×148 mm), the bible size (171 mm×95 mm), the mini 6 size (126 mm×80 mm) and the mini 5 size (105 mm×61 mm). The sizes stored in the "recording sheet size" field are only examples of standardized sizes that are popular for perforated sheets of paper, thus standardized sizes are not necessarily limited thereto. The information stored in the pattern table 36 may be modified according to the information transmitted from the operation panel 40 or the terminal device 70 by a predetermined operation.

The "position" field stores information about the position where perforation 15 is pre-formed in the recording sheet 50. Thus, based on the information stored in the "position" field, the control unit 100 can determine the position where perforation 15 is pre-formed in the recording sheet 50 that has the standardized size. In FIG. 9, the pattern table 36 shows information on the coordinate of the position of the perforation 15 that will be detected first by the medium sensor 47 when a recording sheet 50 having perforations 15 is conveyed along the conveyance path 23. The "position" field stores information about the all positions of the perforation pre-formed in the recording sheet 50. The "shape" field stores information about the shape of the perforations 15 pre-formed in the recording sheet 50. The shape of the perforations 15 may be round or angular ("tetragonal" in FIG. 9).

The "size" field stores information about "small" or "large" indicating the size of the perforation 15 which is pre-formed in the recording sheet 50 having the standardized size. The "number of perforations" field stores information about the number of perforations 15 that are pre-formed in the recording sheet 50 having the standardized size. The "pattern" field stores information about one of the pattern image data A through the pattern image data D.

The control unit 100 makes the following determinations by referring to the pattern table 36. The control unit 100 determines that a perforation 15 is formed at a position (X1, Y1) for the A4-size recording sheet 50 that is conveyed along the conveyance path 23. Thus, the control unit 100 determines that two large size round perforations are pre-formed in the recording sheet 50 at predetermined positions. Further, the control unit 100 determines that the printing data in the first regions 65 corresponding to the two perforations 15 should be substituted by the pattern image data A. In other words, the control unit 100 refers the pattern table 36 by using information about the size of the recording sheet (A4) and the position (X1, Y1) of single perforation. Thus, based on the information, the control unit 100 acquires, from the pattern table 36, positions of all perforation 15, the size of the perforation 15, the pattern image 35, the number of the perforations. The information to refer the pattern table 36 may include, for example, information about the size of the perforation 15, and the shape of the perforation 15, which are detected.

As another example, the control unit 100 makes the following determinations by referring to the pattern table 36. The control unit 100 determines that a perforation 15 is formed at a position (X5, Y5) for the bible-size recording sheet 50 being conveyed along the conveyance path 23. Thus, the control unit 100 determines that six small size round perforations are pre-formed in the recording sheet 50 at predetermined positions. Further, the control unit 100 determines that the printing data in the first regions 65 corresponding to the six perforations 15 should be substituted by the pattern image data B.

In the embodiment, the control unit 100 specifies the arrangement pattern of the perforations 15 pre-formed in the recording sheet 50 that is conveyed along the conveyance path 23, based on the size of the recording sheet 50 specified for the printing data, the information stored in the pattern table 36, and the result of the detection of the medium sensor 47. The arrangement pattern includes the shape of perforations, the size of perforations, the number of perforations, the positions of perforations, and the pitch of arrangement of perforations. Based on the specified arrangement pattern, the control unit 100 replaces the corresponding part of the printing data for the pattern image data. Here, the pattern image data is selected from the pattern image data 35 based on the arrangement pattern.

The control unit 100 receives the size of the recording sheet 50 to be supplied from the sheet feeding tray 20 into the conveyance path 23 before the start of the image recording process. When a perforation 15 is detected by the medium sensor 47, the control unit 100 determines the arrangement pattern of the perforations 15 pre-formed in the recording sheet 50 being conveyed, based on the received size of the recording sheet 50, the detected position of one perforation, the shape of the perforation, and the information stored in the pattern table 36. Based on the arrangement pattern, the control unit 100 defines the first regions 65 for all the perforations 15 that are estimated to be pre-formed in the recording sheet 50. In other words, the control unit 100 imaginarily divides the recording sheet 50 into the first regions 65 that include regions where the perforations are preformed, and the second region 68 that excludes the first regions, based on the arrangement pattern. The control unit 100 substitutes the pattern image data 35 for each of the defined first regions 65. Accordingly, the recording head 39 can eject ink onto the recording sheet 50, avoiding all the perforations 15, without detecting all the perforations 15 that are pre-formed in the recording sheet 50.

Figure 10:
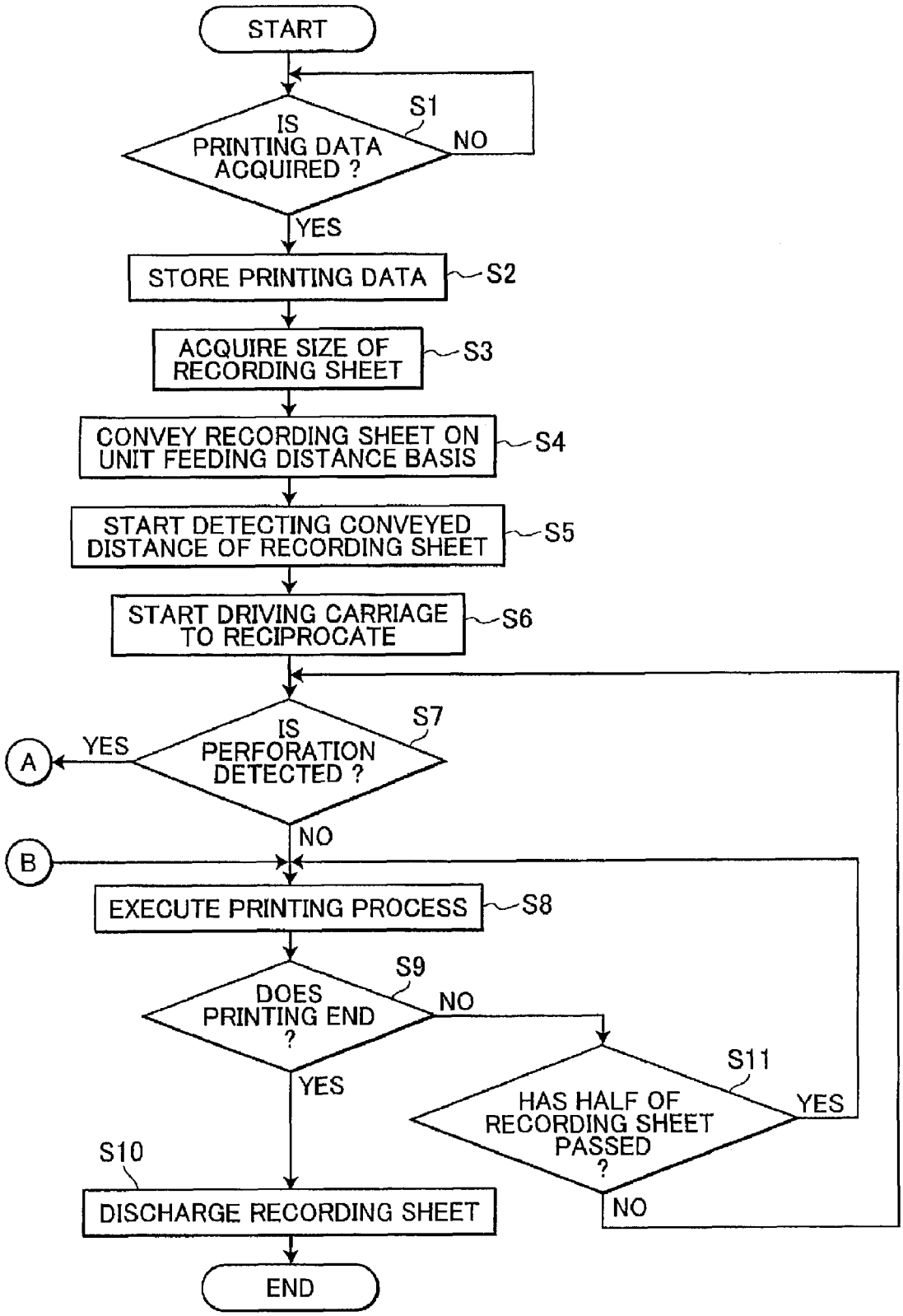
FIG. 10 schematically shows a flowchart illustrating a part of a process executed by the multifunction device when acquiring printing data from a terminal device.
Figure 11:
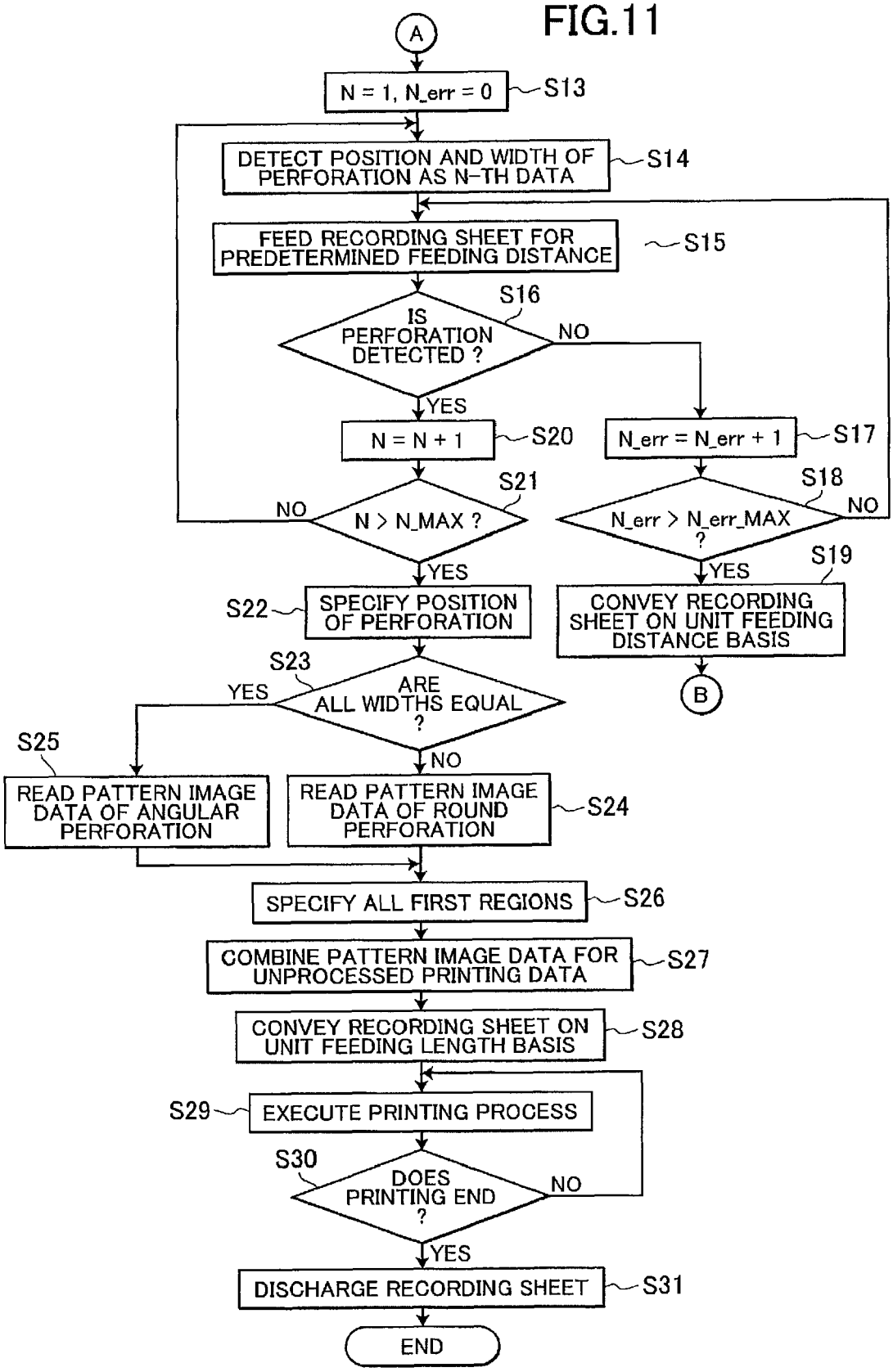
FIG. 11 schematically shows a flowchart illustrating a remaining part of the process shown in FIG. 10.

An image recording method according to the embodiment will be described below. FIGS. 10 and 11 schematically show a flowchart illustrating the sequence of the process to be executed by the multifunction device 10 when the multifunction device 10 receives printing data from the terminal device 70. The process that the multifunction device 10 executes in a manner as described below by referring to the flowchart will be executed according to the instructions issued by the control unit 100 based on a control program stored in the ROM 102.

First, in S1, the control unit 100 determines whether the printing data has been received or not. More specifically, the control unit 100 determines whether the printing data transmitted from the terminal device 70 has been received or not. If the control unit 100 determines that the printing data has not been received (S1: NO), the multifunction device 10 is held to a standby state. On the other hand, if the control unit 100 determines that the printing data has been received (S1: YES), in S2, the control unit 100 stores the received printing data in the RAM 103. Subsequently, in S3, the control unit 100 specifies the size of the recording sheet 50 from the information included in the printing data and obtains the size of the recording sheet 50. That is, the control unit 100 receives the printing data including information specifying the size of recording sheet 50 from the terminal device 70, and the control unit 100 obtains the size of the recording sheet 50 to be conveyed along the conveyance path 23.

In S4, the control unit 100 rotates the sheet feeding roller 25 to supply the recording sheet 50 into the conveyance path 23 from the sheet feeding tray 20. When the leading edge of the recording sheet 50 reaches the nip position of the conveyance roller 60 and the pinch roller 31, the control unit 100 controls the rotation of the conveyance roller 60 and the sheet discharging roller 62 so as to convey the recording sheet 50 on the unit feeding distance basis along the conveyance path 23. In S5, the control unit 100 starts the process of detecting the conveyed distance of the recording sheet 50 by the rotary encoder 83, from the start of the processing of step S4. The control unit 100 can determine whether the leading edge of the recording sheet 50 reaches the nip position of the conveyance roller 60 and the pinch roller 31 based on the conveyed distance of the recording sheet 50. Here, the conveyed distance of the recording sheet 50 is specified by the rotation amount of the rotary encoder 83 from the time when the leading edge of the recording sheet 50 is detected by the register sensor 71. In S6, the control unit 100 drives the carriage 38 to reciprocate in the main scanning direction.

In S7, the control unit 100 determines whether the perforation 15 pre-formed in the recording sheet 50 being conveyed on the platen 42 is detected based on the detection signal output from the media detection circuit 72. If the control unit 100 determines that the perforation 15 is not detected (S7: NO), the control unit 100 executes the printing process in S8. More specifically, the control unit 100 controls the recording head 39 to scan in the main scanning direction while ejecting ink from the recording head 39 so as to record the image by each line. The printing data to be used for the printing process is sequentially converted from the RGB format into the CMYBk format on a line by line basis and transferred to the head control circuit 33. The control unit 100 records the image on the recording sheet 50 by controlling the recording head 39 through the head control circuit 33 based on the printing data.

In S9, the control unit 100 determines whether the printing process has ended or not. That is, the control unit 100 determines whether the recording head 39 has completed the process of recording the image for the entire printing data or not. If the control unit 100 determines that the printing process has ended (S9: YES), in S10, the control unit 100 discharges the recording sheet 50 from the conveyance path 23 onto the sheet discharging tray 21. On the other hand, if the control unit 100 determines that the printing process has not ended yet (S9: NO), in S11, the control unit 100 controls the medium sensor 47 to determine whether a half of the recording sheet 50 has passed the medium sensor 47 in the conveyance direction 17. This determination is performed based on the size of the recording sheet 50 (the length of the recording sheet 50 in the conveyance direction 17) received in the step S3 and the conveyed distance of the recording sheet 50 detected by the rotary encoder 83. If the control unit 100 determines that the half of the recording sheet 50 has passed the medium sensor 47 in the conveyance direction 17 and no perforation 15 has been detected yet (S11: YES), the control unit 100 determines that the recording sheet 50 does not have any perforation 15. Subsequently, the control unit 100 returns to S8. In other words, when the medium sensor 47 does not detect the perforation 15 from the leading edge of the recording sheet 50 to a middle position of the recording sheet 50 in the conveyance direction 17, the control unit 100 determines that no perforation 15 is pre-formed in the recording sheet 50 and quits the processing operation of detecting a perforation 15 (the step S7). If, on the other hand, the control unit 100 determines that the half of the recording sheet 50 has not passed the medium sensor 47 in the conveyance direction 17 yet (S11: NO), the control unit 100 returns to S7. In other words, the processing operation of detecting a perforation 15 is continued until the half of the recording sheet 50 in the conveyance direction 17 passes the medium sensor 47. In this way, the control unit 100 tries to detect a perforation 15 to the middle point of the recording sheet 50 with respect to the conveyance direction 17.

If the control unit 100 determines that a perforation 15 is detected by the medium sensor 47 (S7: YES), in S13 as shown in FIG. 11, the control unit 100 sets "1" to N and "0" to N_err. N is the number of processes performed for detecting a perforation 15 (the detection process that is performed during the second action). N_err is the number of errors that have occurred during the repeat of the detection process. The set values in N and N_err are temporarily stored in a predetermined area of the RAM 103. While the medium sensor 47 (carriage 38) is moved in the main scanning direction, in S14 the control unit 100 detects the position and the width of the perforation 15 with respect to the main scanning direction associated with the value N (N=1 in this example). The control unit 100 performs S14 based on the detection signal output from the media detection circuit 72 while reciprocating the medium sensor 47 and the result of the detection of the linear encoder 84.

Subsequently, in S15 the control unit 100 moves the recording sheet 50 by a predetermined feeding distance S. In other words, the control unit 100 performs the above-described second action once. As a result, the recording sheet 50 is conveyed by the predetermined feeding distance S. Subsequently, the carriage 38 is moved in the main scanning direction. In S16 the control unit 100 determines whether the perforation 15 is detected, based on the detection signal output from the media detection circuit 72 while moving the carriage 38. If the control unit 100 determines that no perforation 15 has been detected (S16: NO), in S17 the control unit 100 increments N_err by "1". In S18 the control unit 100 determines whether the currently set N_err is greater than N_err_Max or not. That is, the control unit 100 determines whether the number of detection errors by the medium sensor 47 has exceeded the predetermined number of times (for example, 3 times (N_err_Max=3)) or not. If the control unit 100 determines that N_err is smaller than N_err_Max (S18: NO), the control unit 100 returns to S15. On the other hand, if the control unit 100 determines that N_err exceeds N_err_Max (S18: YES), the control unit 100 proceeds to S19. In S19 the control unit 100 controls the rotation of the conveyance roller 60 and rotation of the sheet discharging roller 62 to convey the recording sheet 50 on the unit feeding distance basis. In other words, the control unit 100 resumes the first action. After the step S19, the control unit 100 returns to S8.

If the control unit 100 determines that a perforation 15 is detected (S16: YES), in S20 the control unit 100 increments N by "1". Subsequently, in S21 the control unit 100 determines whether the current value N is greater than N_MAX (a predetermined number not less than 2: for example, N_MAX=3). If the control unit 100 determines that the current value N does not exceed N_MAX (S21: NO), the control unit 100 repeats the processing operations from S14 once again. On the other hand, if the control unit 100 determines that the current value N exceeds N_MAX (S21: YES), in S22 the control unit 100 specifies the position of the perforations 15 based on the information obtained as a result of the step S14 that is repeated N times. As described above, the position of the perforations 15 is determined based on the detection signal output from the medium sensor 47 (the media detection circuit 72) that detects the recording sheet 50, the result of detection of the linear encoder 84 that controls the reciprocation of the carriage 38, and the result of detection of the rotary encoder 83 that controls the conveyance of the recording sheet 50. The process of specifying the position of the perforations 15 is simple and easy because no specific equipment is required to specify the position of the perforation 15. In S23 the control unit 100 determines whether the widths of the perforation 15 obtained for the N times in the step S14 agree with each other.

As described above, if the perforation 15 is angular perforation, the width of the detected perforation 15 before the recording sheet 50 is conveyed for the predetermined feeding distance S (before S15 is performed) is subsequently equal to the width of the detected perforation 15 after the recording sheet 50 is conveyed for the predetermined feeding distance S (after S15 is performed). On the other hand, if the perforation 15 is round perforation, the width of the detected perforation 15 differs before and after the step S15 is performed. Thus, the shape of the perforation 15 (angular perforation or round perforation) can be easily determined based on the widths of the detected perforation 15 before and after the recording sheet 50 is conveyed for a predetermined feeding distance S.

If the control unit 100 determines that the widths of the perforation 15 detected for N times differ with one another (S23: NO), in S24 the control unit 100 determines that the detected perforation 15 is a round perforation and reads out one pattern image data 35 for a round perforation (the pattern image data A or the pattern image data B) that corresponds to the size of the recording sheet 50 obtained as a result of the step S3 from the EEPROM 104. Here, the control unit 100 determines the pattern image data 35 (the pattern image data A or the pattern image data B) referring to the pattern table 35 based on the received size of the recording sheet 50, and the position and shape of the perforation 15. On the other hand if the control unit 100 determines that the width of the perforation 15 detected for N times are substantially equal (S23: YES), in S25 the control unit 100 determines that the detected perforation 15 is an angular perforation and reads out one pattern image data 35 for an angular perforation (the pattern image data C or the pattern image data D), that corresponds to the size of the recording sheet 50 obtained as a result of the step S3 from the EEPROM. Here, the control unit 100 determines the pattern image data 35 (the pattern image data C or the pattern image data D) referring to the pattern table 35 based on the received size of the recording sheet 50, and the position and shape of the perforation 15.

After the step S24 or step S25, in S26 the control unit 100 determines the arrangement pattern of the perforations 15 and specifies all the first regions 65. More specifically, the control unit 100 sets the first regions 65 for all the perforations 15 that is assumed to be pre-formed in the recording sheet 50 based on the information about the perforation 15 that is detected first and the information in the pattern table 36. The process of the step S24 and the step S26, or the process of the step S25 and the step S26 is performed by referring to the pattern table 36 as described above and hence they will not be described here in detail.

In S27 the control unit 100 combines pattern image data 35 with the printing data that have not been used for printing. More specifically, the control unit 100 combines pattern image data 35 with the part of the printing data in the RGB format that have not been transferred to the head control circuit 33. In other words, the control unit 100 substitutes the read out pattern image data 35 in the step S24 or the step S25 for part of the printing data in the RGB format that have not been transferred to the head control circuit 33. As a result of executing the step S27, the printing data corresponding to each of the first regions 65 is substituted by the pattern image data 35 and transferred to the head control circuit 33.

In other words, the control unit 100 modifies the printing data so that each of the plurality of first regions 65 is printed with a pattern image data 35 based on the arrangement pattern of the plurality of perforations 15.

In S28 the control unit 100 conveys the recording sheet 50 for the unit feeding distance as in S19. In S29 the control unit 100 executes the printing process as in S8. As a result of the step S29, ejection of ink from the recording head 39 onto the first regions 65 is prohibited and ink is ejected from the recording head 39 only onto the second region 68 for borderless printing.

In S30 the control unit 100 determines whether the recording head 39 has completed the process of recording the image for the entire printing data as in S9. The control unit 100 returns to S29 if the control unit 100 determines that the printing process has not ended (S30: NO). On the other hand, if the control unit 100 determines that the printing process has ended (S30: YES), in S31 the control unit 100 discharges the recording sheet 50 from the conveyance path 23 onto the sheet discharging tray 21.

As described above, when the control unit 100 acquires printing data, a recording sheet 50 is conveyed along the conveyance path 23. The medium sensor 47 detects the perforation 15 while the recording sheet 50 is being conveyed. An image is recorded on the recording sheet 50 based on the printing data by ejecting ink from the recording head 39 onto the recording sheet 50 while the recording sheet 50 is conveyed. If the perforation 15 is detected, the printing data to be used for printing in each of the first regions 65 are substituted by the pattern image data 35 (see FIGS. 8(A)-8(D)). The pattern image data 35 is pixel data indicative of a blank area. When the pattern image data 35 is supplied to the recording head 39 as printing data to be used for recording in the first region 65, no ink is ejected from the recording head 39 onto the first region 65 (see FIGS. 8(A)-8(D)). Since ink is ejected to avoid the perforations 15 from the recording head 39, the situation where ink passes through the perforations 15 to smear the platen 42 and the recording sheet 50 is avoided.

Ink is ejected from the recording head 39 onto the second region 68. More specifically, ink is ejected onto the region between two of the adjacent perforations 15 and the region between the perforations 15 and the edge 53 (see FIGS. 8(A)-8(D)). An image is recorded in the region between a perforation 15 and the adjacent perforation 15. An image is recorded in the region between the perforation 15 and the edge 53 closest to the perforation 15 of the recording sheet 50. Since the printer section 11 of the embodiment has a function for borderless printing, a recording sheet 50 formed with perforations 15 can be used for borderless printing.

The medium sensor 47 is mounted in the carriage 38 that reciprocates in the main scanning direction. The control unit 100 can determine whether the recording sheet 50 has perforations 15 for whole region of the recording sheet 50. Since the medium sensor 47 is located at the upstream side of the recording head 39 in the conveyance direction 17, the perforation 15 can be detected before recording an image in the first region 65. Thus, there does not arise any problem of ejecting ink above detected perforation 15.

The control unit 100 determines whether the recording sheet 50 conveyed along the conveyance path 23 has perforation 15 from a leading edge of the recording sheet 50 to a prescribed position of the recording sheet 50 in the conveyance direction 17. The prescribed position is set at substantially the middle point of the recording sheet 50 with respect to the conveyance direction 17. For the general recording sheet 50, perforations 15 are symmetrically pre-formed in the recording sheet 50 with respect to the middle point in the conveyance direction 17. If no perforation 15 is detected between the leading edge of the recording sheet and the middle point of the recording sheet in the conveyance direction, the control unit 100 determines that the recording sheet 50 does not have the perforation 15. This construction avoids waste of the detection process if the recording sheet 50 supplied to the conveyance path 23 does not have the perforation 15. In other words, this construction reduces time spent for recording an image on the recording sheet 50 compared with the conceivable case where the medium sensor 47 detects the perforation 15 over the entire length of the recording sheet 50 in the conveyance direction 17.

While the invention has been described in detail with reference to the above embodiment thereof, it would be apparent to those skilled in the art that various changes and modifications may be made therein without departing from the spirit of the invention.

Instead of substituting the pattern image data 35 for part of the printing data, the area where ink is ejected from the recording head 39 may be controlled so as to prohibit ejection of ink onto the first regions 65. More specifically, setting information about the ink ejection area of the recording head 39 in the main scanning direction is written in the register (not shown) in the head control circuit 33. When a perforation 15 pre-formed in the recording sheet 50 is detected, the setting information about the ink ejection area is rewritten so as to remove the first regions 65 from the ink ejection area. With this construction, when printing data is input to the head control circuit 33, ink is not ejected from the recording head 39 onto a region of the perforations 15 pre-formed in the recording sheet 50.

While the embodiment is described above in borderless printing, or recording an image on the recording sheet 50 without margins, slight margins (white space) (for example, about 1 mm to 3 mm) may be set on the recording sheet 50. In other words, the second region 68 may not be a region extending from the center of the recording sheet 50 to the edge 53 thereof.

When margins are provided on the recording sheet 50, the second region may be set as follows. The second region excludes the region between the first regions 65 and the edge 53 closest to the first regions 65.

The second region 68 may be set so as not to include the regions between two adjacent perforations 15 if the perforations 15 are located at a small pitch (with small gaps separating perforations 15). In other words, the second region 68 may exclude each of regions between a perforation 15 included in the first region 65 and an adjacent perforation 15.

While the arrangement pattern of perforations is determined according to the position of the perforation, the size of the perforation and the shape of the perforation in the above-described embodiment, the arrangement pattern of perforation can be determined at least if the position of the perforations is accurately specified. An image can be recorded appropriately by dividing the first regions and the second region that correspond to the specified arrangement pattern.

While the arrangement pattern of perforations is determined according to the detected perforation in the above-described embodiment, the positions of all the perforations may be detected, and an image may be recorded so as to avoid the positions of the perforations. With this construction, an image can be appropriately recorded on a recording sheet without registering arrangement patterns. Further, with this construction, an image can be recorded on a recording sheet having perforations whose arrangement pattern is not previously registered.

While the medium sensor 47 is used as a perforation detecting sensor and is moved with the recording head 39 in a direction perpendicular to the conveyance direction in the above-described embodiment, an perforation detecting sensor may be independent from the recording head 39. In this case, the perforation detecting sensor is driven to move in a direction perpendicular to the conveyance direction. With this construction, the invention can be applied to a recording device formed with a recording head equipped with recording elements over the entire width thereof.

The positions of the perforations, the size of the perforations and the shape of the perforations can be detected by arranging a perforation detecting sensor so as to cover the entire width of the recording sheet in a direction perpendicular to the conveyance direction. With this construction, an image can be printed in a desired manner. For example, the image can be printed in a region between two adjacent perforations and a region between the perforation and the edge closest to the perforation.

In the embodiment, for detecting the position of the perforation 17, the rotary encoder 83 detects the conveyed distance of the recording sheet 50 in the conveyance direction, and the linear encoder 84 detects the moving distance of the medium sensor 45 (perforation detecting sensor) in a direction perpendicular to the conveyance direction. However, for detecting the position of the perforation, other methods may alternatively be employed. For example, the number of pulses that drive a pulse motor may be counted from a reference position to a time when the perforation is detected.

In the embodiment, the control unit 100 determines whether the perforation is formed in the recording sheet from the leading edge of the recording sheet to the middle position of the recording sheet in the conveyance direction 17. However, the control unit 100 determines whether the perforation is formed in the recording sheet for a part of the recording sheet in the conveyance direction 17. For example, the control unit 100 determines whether the perforation is formed in the recording sheet from the middle position of the recording sheet to the trailing edge of the recording sheet in the conveyance direction 17.

While the ink-jet recording system is employed in the above-described embodiment, the invention can also be applied to the electro-photographic system, the thermal printing system and other systems.

What is claimed is:

1. An image recording device comprising:

a conveying unit that conveys an object subject to conveyance along a conveyance path in a first direction;

a first detecting unit that detects a position of a perforation pre-formed in the object;

a recording unit that records an image on the object based on printing data; and a control unit that is configured to divide the object into a first region comprising a portion where the perforation is pre-formed and a second region excluding the first region based on the position of the perforation detected by the first detecting unit, wherein the control unit prohibits the recording unit from recording the image on the first region and controls the recording unit to record the image at least partially on the second region, wherein the recording unit comprises a recording head, and wherein the first detecting unit comprises an optical sensor which optically detects the perforation pre-formed in the object, and the optical sensor is configured to reciprocate in a second direction orthogonal to the first direction.

2. The image recording device as claimed in claim 1, wherein a plurality of perforations are pre-formed in the object, the object being divided into a plurality of first regions, each first region of the plurality of first regions comprising one of the plurality of perforations and a second region excluding the plurality of first regions, wherein the second region comprises a portion interposed between two adjacent first regions, and wherein the control unit prohibits the recording unit from recording the image on the plurality of first regions and controls the recording unit to record the image at least partially on the second region.

3. The image recording device as claimed in claim 2, wherein the control unit controls the recording unit to record the image on the portion interposed between the two adjacent first regions.

4. The image recording device as claimed in claim 2, further comprising:

a storing unit that stores, in association with a size of the object, information about a shape of the perforation, a size of the perforation, and a position of the perforation; and a retrieving unit that is configured to retrieve information about the size of the object subject to recordation, wherein the control unit determines an arrangement of the plurality of perforations pre-formed in the object based on the information about the size of the object retrieved by the retrieving unit, the information stored in the storing unit, and a result of detection by the first detecting unit, and wherein the control unit modifies the printing data so that each of the plurality of first regions is printed with a prescribed pattern based on the determination made with respect to the arrangement of the plurality of perforations.

5. The image recording device as claimed in claim 4, wherein no image is recorded in each of the plurality of first regions resulting from modification of the printing data.

6. The image recording device as claimed in claim 1, wherein the second region comprises a portion interposed between the first region and an edge of the object closest to the first region.

7. The image recording device as claimed in claim 6, wherein the control unit controls the recording unit to record the image on the portion interposed between the first region and the edge of the object closest to the first region.

8. The image recording device as claimed in claim 1, wherein the control unit modifies the printing data so that the first region is recorded with a prescribed pattern.

9. The image recording device as claimed in claim 8, wherein no image is recorded in the first region resulting from modification of the printing data.

10. The image recording device as claimed in claim 1, wherein the first detecting unit performs detection of the position of the perforation with respect to at least a part of the object in the first direction.

11. The image recording device as claimed in claim 10, wherein the part of the object extends from a leading edge of the object to an intermediate point in the first direction.

12. The image recording device as claimed in claim 1, wherein the optical sensor is disposed at an upstream side of the recording head in the first direction.

13. The image recording device as claimed in claim 12, wherein the first detecting unit detects the position of the perforation while the optical sensor reciprocates.

14. The image recording device as claimed in claim 13, wherein the conveying unit coveys the object intermittently, and the first detecting unit determines whether the perforation has a round shape or an angulated shape based on a change of widths that are detected before and after the intermittent conveyance of the object by the conveying unit.

15. The image recording device as claimed in claim 12, further comprising:

a second detecting unit that detects a position of the optical sensor relative to the object in the second direction; and a third detecting unit that detects an amount of conveyance of the object;

wherein the first detecting unit detects the position of the perforation pre-formed in the object based on results of detections by the optical sensor, the second detecting unit, and the third detecting unit.

16. The image recording device as claimed in claim 1, wherein the recording head is configured to record the image without preserving margins on the object.

17. An image recording device comprising:

a conveying unit configured to convey an object subject to conveyance along a conveyance path in a first direction;

a first detecting unit configured to detect a position of a hole pre-formed in the object;

a recording unit configured to record an image on the object based on printing data; and a control unit configured to divide the object into a first region comprising a portion in which the hole is pre-formed and a second region excluding the first region based on the position of the hole detected by the first detecting unit, wherein the control unit is configured to prohibit the recording unit from recording the image on the first region and to control the recording unit to record the image at least partially on the second region, wherein the recording unit comprises a recording head, and wherein the first detecting unit comprises an optical sensor configured to detect optically the hole pre-formed in the object, and the optical sensor is configured to reciprocate in a second direction orthogonal to the first direction.

18. The image recording device as claimed in claim 17, wherein the optical sensor is disposed at an upstream side of the recording head in the first direction.

19. The image recording device as claimed in claim 18, wherein the first detecting unit is configured to detect the position of the hole while the optical sensor reciprocates.

20. The image recording device as claimed in claim 18, further comprising:

a second detecting unit configured to detect a position of the optical sensor relative to the object in the second direction; and a third detecting unit configured to detect an amount of conveyance of the object, wherein the first detecting unit is configured to detect the position of the hole pre-formed in the object based on results of detections by the optical sensor, the second detecting unit, and the third detecting unit.

21. The image recording device as claimed in claim 17, wherein the conveying unit is configured to convey the object intermittently, and the first detecting unit is configured to determine whether the hole has a round shape or an angulated shape based on a change of widths detected before and after the intermittent conveyance of the object by the conveying unit.

22. The image recording device as claimed in claim 17, wherein the recording head is configured to record the image without preserving margins on the object.

23. The image recording device as claimed in claim 17, wherein the hole pre-formed in the object is a through-hole.

* * * * *